US009055381B2

(12) United States Patent
Kirkeby et al.

(10) Patent No.: US 9,055,381 B2
(45) Date of Patent: Jun. 9, 2015

(54) MULTI-WAY ANALYSIS FOR AUDIO PROCESSING

(75) Inventors: Ole Kirkeby, Espoo (FI); Gaetan Lorho, Helsinki (FI); Jussi Kalevi Virolainen, Espoo (FI); Ravi Shenoy, Bangalore (IN); Pushkar Prasad Patwardhan, Thane (IN)

(73) Assignee: Nokia Technologies Oy, Espoo (FI)

( * ) Notice: Subject to any disclaimer, the term of this patent is extended or adjusted under 35 U.S.C. 154(b) by 367 days.

(21) Appl. No.: 13/500,625

(22) PCT Filed: Oct. 12, 2010

(86) PCT No.: PCT/IB2010/054622

§ 371 (c)(1),
(2), (4) Date: Apr. 5, 2012

(87) PCT Pub. No.: WO2011/045751

PCT Pub. Date: Apr. 21, 2011

(65) Prior Publication Data

US 2012/0207310 A1 Aug. 16, 2012

(30) Foreign Application Priority Data

Oct. 12, 2009 (IN) ..... 2115/DEL/2009

(51) Int. Cl.
*H04R 5/00* (2006.01)
*H04S 5/00* (2006.01)

(52) U.S. Cl.
CPC ..... *H04S 5/005* (2013.01); *H04S 2420/01* (2013.01)

(58) Field of Classification Search
CPC ..... H04S 5/00; H04S 5/005; H04S 2420/01
USPC ..... 381/17
See application file for complete search history.

(56) References Cited

U.S. PATENT DOCUMENTS

| | | | |
|---|---|---|---|
| 5,371,799 | A | 12/1994 | Lowe et al. |
| 5,502,747 | A | 3/1996 | McGrath |
| 5,596,644 | A | 1/1997 | Abel et al. |
| 5,659,619 | A | 8/1997 | Abel |
| 5,659,691 | A | 8/1997 | Durward et al. |
| 5,742,689 | A | 4/1998 | Tucker et al. |
| 5,928,311 | A | 7/1999 | Leavy et al. |
| 5,970,152 | A | 10/1999 | Klayman |

(Continued)

FOREIGN PATENT DOCUMENTS

| | | | |
|---|---|---|---|
| EP | 0984667 | A2 | 3/2000 |
| WO | 2005/048653 | A1 | 5/2005 |

OTHER PUBLICATIONS

Search Report for European Application No. 10 82 3125 dated Sep. 27, 2013.

(Continued)

*Primary Examiner* — Sonia Gay
(74) *Attorney, Agent, or Firm* — Alston & Bird LLP

(57) ABSTRACT

It is disclosed to determine, for a direction being at least associated with a value of a first direction component and with a value of a second direction component, at least one weighting factor for each basis function of a set of basis functions, each of the basis functions being associated with an audio transfer characteristic, wherein said determining is at least based on a first set of gain factors, associated with the first direction component, and on a second set of gain factors, associated with the second direction component

20 Claims, 16 Drawing Sheets

(56) References Cited

U.S. PATENT DOCUMENTS

| | | | | |
|---|---|---|---|---|
| 7,003,119 | B1 | 2/2006 | Arthur | |
| 7,167,567 | B1 * | 1/2007 | Sibbald et al. | 381/17 |
| 2005/0276430 | A1 | 12/2005 | He et al. | |
| 2006/0198542 | A1 * | 9/2006 | Touimi et al. | 381/307 |
| 2007/0025559 | A1 * | 2/2007 | Mihelich et al. | 381/59 |
| 2008/0273708 | A1 * | 11/2008 | Sandgren et al. | 381/63 |
| 2009/0141961 | A1 * | 6/2009 | Smith et al. | 382/135 |
| 2011/0135098 | A1 * | 6/2011 | Kuhr et al. | 381/17 |

OTHER PUBLICATIONS

Qinghua, H. et al., *Interpolation of Head-Related Transfer Functions Using Sphercial Fourier Expansion*, Journal of Electronics (China), vol. 26, No. 4 (Jul. 2009), 571-576.

Smilde, A. et al., *Multi-way Analysis, Application in the Chemical Sciences*, John Wiley and Sons, (2004) pp. 113-124.

Xiao, T. et al., *Finite Different Computation of Head-Related Transfer Function for Human Hearing*, J. Acoust. Soc. Am. 113 (5), May 2003, pp. 2434-2441.

Martens, "Principal Components Analysis and Resynthesis of Spectral Cues to Perceived Direction", Proceedings of the International Computer Music Conference, 1987, pp. 274-281.

Kistler et al., "A Model of Head-Related Transfer Functions Based on Principal Components Analysis and Minimum-Phase Reconstruction", Journal of the Acoustical Society of America, vol. 91, No. 3, Mar. 1992, pp. 1637-1647.

Chen et al., "A Spatial Feature Extraction and Regularization Model for the Head-Related Transfer Function", Journal of the Acoustical Society of America, vol. 97, Issue 1, 1995, pp. 439-452.

Wu et al., "A Time Domain Binaural Model Based on Spatial Feature Extraction for Head-Related Transfer Function", Journal of the Acoustic Society of America, vol. 102, Issue 4, 1997, pp. 2211-2218.

"The CIPIC Interface Laboratory Home Page", CIPIC International Laboratory, Retrieved on Apr. 29, 2013, Webpage available at: http://interface.idav.ucdavis.edu/.

International Search Report and Written Opinion received for corresponding Patent Cooperation Treaty Application No. PCT/IB2010/054622, dated Feb. 1, 2011, 14 pages.

Huang et al., "A Reduced Order Model of Head-Related Impulse Responses Based on Independent Spatial Feature Extraction", IEEE International Conference on Acoustics, Speech and Signal Processing, Apr. 19-24, 2009, pp. 281-284.

Acar et al., "Unsupervised Multiway Data Analysis: A Literature Survey", IEEE Transactions on Knowledge and Data Engineering, vol. 21, Issue 1, Jan. 2009, 15 pages.

* cited by examiner

MULTI-WAY ANALYSIS FOR AUDIO PROCESSING

RELATED APPLICATION

This application was originally filed as PCT Application No. PCT/IB2010/054622 filed Oct, 12, 2010, which claims priority benefit to India Patent Application No. 2115/DEL/2009, filed Oct. 12, 2009.

FIELD OF THE DISCLOSURE

This invention relates to the field of spatial audio signal processing.

BACKGROUND

Three dimensional (3D) audio is based on binaural technology and the study of head-related transfer functions (HRTFs). The impulse response from a sound source 140 in 3D space to one of the ears 120, 130 of a listener 110 is called head-related impulse response (HRIR), as illustrated in FIG. 1. The corresponding HRTF may be determined as a Fourier transform of HRIR.

The transfer function corresponding to the impulse response from the source 140 to the near ear 120 (the ear on the same side of the head as the source) is called ipsi-lateral HRTF and the transfer function corresponding to the impulse response from the source 140 to the far ear 130 (the ear on the opposite side of the head as the source) is called the contra-lateral HRTF.

Furthermore, the sound that arrives at the far ear 130 is slightly delayed relative to the sound at the near ear 120, and this delay is referred to as the Interaural Time Difference (ITD). In practice, the duration of an HRTF may be of the order of 1 ms, and the ITD may be smaller than 1 ms.

A single virtual source is conventionally implemented by using two digital filters and a delay as shown in FIG. 2*a* where the overall gains used to emulate the distance attenuation is omitted for convenience.

The filters $H_i$ 210 and $H_c$ 220 correspond to ipsi-lateral and contra-lateral HRTFs, respectively, and the ITD 225 is inserted in the contra-lateral path (which goes to the listener's 110 left ear 130 when the source 140 is on the right as in the example shown in FIG. 1). The filters $H_i$ 210 and $H_c$ 220 are commonly implemented by FIR filters.

A modest performance improvement may be achieved by replacing $H_c$ 220 by a low-order UR filter IATF (Interaural Transfer Function) 240 that processes the output from $H_i$ 210, as depicted in FIG. 2*b*.

The two filter structures represent alternative implementations of the same algorithm when the cascade of 210 and IATF 240 is approximately equal to $H_c$ 220. In practice the IATF can be chosen for example as a first order lowpass filter with good results.

When more virtual sources are needed, more copies of the structure in FIG. 2*a* or FIG. 2*b* are required. It is not possible to combine the processing blocks $H_i$ 210, $H_c$ 220 IATF 240 and ITD 225 because they are specific to the position of each virtual source.

An alternative method based on the principal component analysis (PCA) technique can be used for the implementation of virtual sound sources. This approach differs from the filtering method shown in FIG. 2*b* (or FIG. 2*a*) in the sense that it uses a set of filters having unvarying frequency or impulse response characteristics and a set of gains varying with sound source location. These filters and gains are derived through PCA, a statistical analysis technique that allows the extraction of some common trends in the data (note that Singular Value Decomposition (SVD) and Karhunen-Loeve expansion are variants of this technique). In practice, an HRIR or HRTF dataset is arranged in a two-way array where each column represents the response at one ear for a given sound source position, where the sound source position is determined by a single parameter, not enabling e.g. distinction between elevations and azimuth angles associated with the position. A PCA is then applied to this matrix.

The outcome of this statistical decomposition is a set of N orthogonal basis functions representing the desired unvarying filters and N sets of gains corresponding to the N orthogonal basis functions, each of the N sets of gains, each set comprising a gain value corresponding to each of the sound source positions represented by the original HRTF dataset. Therefore, an approximation of any of the original HRIR or HRTF filters can be reconstructed by a linear combination of the basis functions by multiplying each basis function by a gain value associated with respective sound source position.

SUMMARY OF SOME EMBODIMENTS OF THE INVENTION

A first method is described, which comprises determining, for a direction being at least associated with a value of a first direction component and with a value of a second direction component, at least one weighting factor for each basis function of a set of basis functions, each of the basis functions being associated with an audio transfer characteristic, wherein said determining is at least based on a first set of gain factors, associated with the first direction component, and on a second set of gain factors, associated with the second direction component.

Moreover, a first apparatus is described, which comprises means for determining, for a direction being at least associated with a value of a first direction component and with a value of a second direction component, at least one weighting factor for each basis function of a set of basis functions, each of the basis functions being associated with an audio transfer characteristic, wherein said determining is at least based on a first set of gain factors, associated with the first direction component, and on a second set of gain factors, associated with the second direction component.

The means of this apparatus can be implemented in hardware and/or software. They may comprise for instance a processor for executing computer program code for realizing the required functions, a memory storing the program code, or both. Alternatively, they could comprise for instance a circuit that is designed to realize the required functions, for instance implemented in a chipset or a chip, like an integrated circuit.

Moreover, a second apparatus is described, which comprises at least one processor and at least one memory including computer program code, the at least one memory and the computer program code, with the at least one processor, configured to cause the apparatus at least to perform the actions of the presented first method.

Moreover, a computer readable storage medium is described, in which computer program code is stored. The computer program code causes an apparatus to realize the actions of the presented first method when executed by a processor.

The computer readable storage medium could be for example a disk or a memory or the like. As an example, the memory may represent a memory card such as SD and micro SD cards or any other well-suited memory cards or memory sticks. The computer program code could be stored in the computer readable storage medium in the form of instructions encoding the computer-readable storage medium. The computer readable storage medium may be intended for taking part in the operation of a device, like an internal or external hard disk of a computer, or be intended for distribution of the program code, like an optical disc.

For instance, this audio transfer characteristic may be associated with a transfer function representative. For instance, this transfer function representative may be an unvarying frequency or impulse response characteristic. Furthermore, for instance, each of the set of basis functions may represent a filter function being associated with the respective audio transfer characteristic. As an example, such a filter function may be represented by a set of filter coefficients, but any other well suited representation may also be used.

Furthermore, for instance, the first direction component and the second direction component may represent orthogonal components.

The determined at least one weighting factor for each basis function may be used to construct a filter being associated with the respective direction. For instance, a filter may be formed by multiplying each basis function with the respective at least one weighting factor and by combining the weighted basis functions.

The direction may be associated with the direction of an arrival of an input signal. Thus, the set of basis functions and the determined at least one weighting factor for each basis function may be used to construct a filter for filtering an input signal in order to determine a filtered signal according to a virtual source direction in a three-dimensional (3D) auditory space. Accordingly, a virtual sound source in a 3D auditory space can be provided based on the set of basis functions and the determined at least one weighting factor for each basis function.

The set of first gain factors, the set of second gain factors and the set of basis functions may be considered as a multi-way array of data enabling construction of a filter function associated with a freely choosable direction. For instance, this filter database may be generated based on decomposing a given multi-dimensional transfer function database into the set of first gain factors being associated with the first direction component, the set of second gain factors being associated with the second direction component and the set of basis functions. As an example, this multi-dimensional transfer function database may represent a given multi-dimensional HRTF filter database. Thus, such multi-way array of data may be used to construct a HRTF filter for a freely choosable direction.

The direction is at least associated with a value of a first direction component and a value of a second direction component. For instance, the direction may be associated with at least one value being associated with at least one further direction component. Accordingly, for instance, three direction components, four directions components, or more than four directions components may be used. Consequently, determination of the at least one weighting factor may be further based on at least one further set of gain factors, each of the further set of gain factors being associated with one of the at least one further direction component.

For instance, the first and second direction components and the optional at least one further direction component may represent spherical coordinates.

As an example, a first direction component may represent an azimuth dimension, a second direction component may represent an elevation dimension, and a third direction component may represent a distance between a listener and a position in the 3D space.

For instance, employing also a direction component to represent the distance between a listener and a position in the 3D space may be beneficial for example in near-field HRTF rendering, which may be used to create virtual sound sources close to the listener head (e.g. in range of 0.1 to 1 m) in personal 3D auditory displays. Then, as an example, the above mentioned use of azimuth, elevation and distance as a first, second and third direction component, respectively, may be applied, but using only two modes azimuth and distance may also be applied.

Furthermore, as another example, the first and second direction components and the optional at least one further direction component may represent Cartesian coordinates, e.g. like 'x-y-z coordinates', such that the x-coordinate, the y-coordinate and the z-coordinate may represent the first, second and third direction component. Of course, only two dimensions of Cartesian coordinates may be used. As an example, Cartesian coordinates ("x-y-z" coordinates) may be used to determine a position in the 3D space with respect to the position of a listener.

In one embodiment of the described first method, the first direction component represents an azimuth dimension and the second direction component represents an elevation dimension.

Thus, the azimuth dimension and the elevation dimension may be used to define a direction in a three-dimensional (3D) auditory space. For instance, this direction may be defined as a direction from a listener to a position in the 3D space.

The first set of gain factors may comprise gain factors being associated with different azimuth angles and the second set of gain factors may comprise gain factors being associated with different elevation angles.

For instance, the azimuth may be limited to left) (−90°/right) (+90° while the elevation may circulate on 360°. This may allow a natural modeling of the head-shadow effect with mode 'azimuth' and the front-back differences with the mode 'elevation'.

In one embodiment of the described first method, the first set of gain factors comprises a plurality of first subsets of gain factors, each subset of the plurality of first subsets of gain factors being associated with one basis function of the set of basis functions, and the second set of gain factors comprises a plurality of second subsets of gain factors, each subset of the plurality of second subsets of gain factors being associated with one basis function of the set of basis functions.

For instance, the set of basis functions may comprise N basis functions, wherein each of the N basis functions comprises n components. Thus, each basis function may be represented by means of a vector representation $c_k=[c_k(1)\ c_k(2) \ldots c_k(n)]$ wherein $k \in \{1 \ldots N\}$ holds.

Furthermore, as an example, each first subset of gain factors may be represented by means of a vector representation $a_k=[a_k(1)\ a_k(2) \ldots a_k(I)]$ comprising I gain values being associated with different values of the first direction component for the k-th basis function $c_k$, and each second subset of gain factors may be represented by means of a vector representation $b_k=[b_k(1)\ b_k(2) \ldots b_k(J)]$ comprising J gain values being associated with different values of the second direction component for the k-th basis function $c_k$.

Accordingly, each first subset and each second subset of gain factors is associated with one of the basis functions. Thus, weighting a basis function in order to determine a transfer function representative may be performed based on gain factors of the first subset of gain factors and the second subset of gains factors associated with the respective basis function.

A second method is described, which comprises decomposing a multi-dimensional transfer function database into at least: a set of basis functions associated with audio transfer characteristics, a first set of gain factors, associated with a first direction component, and a second set of gain factors, associated with a second direction component.

Moreover, a third apparatus is described, comprising means for decomposing a multi-dimensional transfer function database into at least: a set of basis functions associated with audio transfer characteristics, a first set of gain factors, associated with a first direction component, and a second set of gain factors, associated with a second direction component.

The means of this third apparatus can be implemented in hardware and/or software. They may comprise for instance a processor for executing computer program code for realizing the required functions, a memory storing the program code, or both. Alternatively, they could comprise for instance a circuit that is designed to realize the required functions, for instance implemented in a chipset or a chip, like an integrated circuit.

Moreover, a fourth apparatus is described, which comprises at least one processor and at least one memory including computer program code, the at least one memory and the computer program code, with the at least one processor, configured to cause the apparatus at least to perform the actions of the presented second method.

Moreover, a computer readable storage medium is described, in which a computer program code is stored. The computer program code causes an apparatus to realize the actions of the presented second method when executed by a processor.

The computer readable storage medium could be for example a disk or a memory or the like. As an example, the memory may represent a memory card such as SD and micro SD cards or any other well-suited memory cards or memory sticks. The computer program code could be stored in the computer readable storage medium in the form of instructions encoding the computer-readable storage medium. The computer readable storage medium may be intended for taking part in the operation of a device, like an internal or external hard disk of a computer, or be intended for distribution of the program code, like an optical disc.

The set of basis functions associated with audio transfer characteristics, the first set of gain factors, associated with a first direction component, and the second set of gain factors, associated with a second direction component, may be used for the described first method. Thus, aspects of the described first method and aspects of the described second method may be combined or linked together.

For instance, the multi-dimensional transfer function database may be arranged in a three way array, wherein a first dimension of the array may be associated with a first direction component, a second dimension of the array may be associated with a second direction component and the third dimension may be associated with a transfer function representative. For instance, the transfer function representative associated with the third dimension may be an impulse response or the frequency response corresponding to a direction of arrival in a 3D auditory space, wherein the direction may be described by the first direction component and the second direction component.

Thus, the multi-dimensional transfer function database may comprise for any given value of the first direction component and for any given value of the second direction component stored in the database a corresponding transfer function representative.

For instance, the first direction component may represent a dimension for azimuth and the second direction component may represent a dimension for elevation, but any other well-suited direction components may be applied.

It has to be understood that any other kind of multi-dimensional transfer function database may be applied, for instance a two way array or a four way array. As an example, the two way array may comprise a first dimension associated with a position and a second dimension associated with a transfer function representative.

For instance, the multi-dimensional transfer function database may represent a Head Related Impulse Response (HRIR) database or a Head Related Transfer Function (HR IF) database for a given user or for an artificial head, arranged in a three way matrix.

The multidimensional transfer function database may also represent a set of Head Related Impulse Responses measured at different azimuth angles, elevation angles and distances and represented as a 4-way array where three of the modes are those presented in FIG. 4*a* and the fourth mode relates to distance.

Another example of 4-way array could represent a set of Head Related Impulse Responses measured on several individual human subjects at different azimuth and elevation angles. The interest of this model is to be able to build a generic HRIR model with an individual tuning potential. Indeed, the model terms relating to azimuth, elevation and HRIR filters are 'common' to all individuals while the fourth mode models individual differences.

By combining the two previous examples, it is even possible to consider a 5-way array with the modes azimuth, elevation, distance, individual characteristics and transfer function.

Yet further possibility is to model a 'customization' of the original sound as an additional dimension of the database. Such customization may be for example user preference with respect to (frequency) shaping of the original audio signal. As an example, a user may want to emphasize a first set of frequencies of the signal and de-emphasize a second set of frequencies of the signal. A set of different predetermined (frequency) shaping characteristics may be modeled using an additional database dimension.

The decomposition according to the described second method may be performed by means of a multi-way analysis, wherein the first set of gain factors, the second set of gain factors and the set of basis functions represent a multi-linear model configured to represent the multi-dimensional transfer function database. Thus, a filter transfer function of the multi-dimensional transfer function database can be represented by a linear combination of the basis functions and gain factors found, wherein each of the basis functions is weighted by a gain factor of the first set of gain factors and weighted by a gain factor of the second set of gain factors associated with the respective basis function. For instance, Parallel Factor Analysis (PARAFAC), Tucker-2, Tucker-3 or higher order Tucker models, PARATUCK-2 or any other (related) multi way model handling at least three modes may be used as multi-linear models for a multi-way analysis of the multi-dimensional transfer function database, but any other well-suited multi-way analysis may also be used. As an example, a detailed description of the Alternating Least Squares (ALS) principle and its application to the PARAFAC and Tucker-3 decomposition techniques may be found for example in Age Smilde, Rasmus Bro and Paul Geladi, "Multi-way Analysis, Application in the chemical sciences", John Wiley and Sons, 2004 (pages 113-124). For instance, any other well suited iterative algorithm may be used for estimating the first set of gain factors, the second set of gain factors and the set of basis functions. As an example, an iterative Recursive Least Squares (RLS) algorithm or an iterative Least Minimum Squares (LMS) algorithm or derivatives thereof may be applied.

The basis functions of the set of basis function may represent orthogonal or non-orthogonal basis functions. The number of basis functions may represent a design parameter, enabling a trade-off between complexity and exactness.

Decomposing the database into the first set of gain factors, associated with the first direction component, and into the second set of gain factors, associated with the second direction component, enables separate control of each of the first and second direction components. For instance, this can be used for a flexible interpolation when determining a transfer function representative based on the set of basis functions and the first and second sets of gain factors. When interpolating, the basis functions can be kept constant and the interpolation may only performed based on the first set of gain factors associated with the first direction component and/or based on the second set of gain factors associated with the second direction component.

The algorithm to find the decomposition may be performed in an iterative way and may be constrained in different ways. For instance, assuming that the transfer function representative in the multi-dimensional transfer function database represents an impulse response, the impulse response of the multi-dimensional transfer function database may be reduced to minimum phase impulse responses and time-delays and can then be given as an input to the decomposition process. As another example, the decomposition may be performed on the transfer functions or only on the magnitude responses of the transfer functions. The impulse response may represent a HRIR and the transfer function may represent a HRTF.

In one embodiment of the described first method, the first set of gain factors comprises a plurality of first subsets of gain factors, each subset of the plurality of first subsets of gain factors being associated with one basis function of the set of basis functions, and wherein the second set of gain factors comprises a plurality of second subsets of gain factors, each subset of the plurality of second subsets of gain factors being associated with one basis function of the set of basis functions.

The exemplary notation of the gain factors $a_k$ associated with the first set of gain factors, the gain factors $b_k$ associated with the second set of gain factors and the basis functions $c_k$ will now be used for explaining an exemplary PARAFAC decomposition of the multi dimensional transfer function database.

In one embodiment of the described second method, the multi-dimensional transfer function database is arranged in a multi-way array having at least three dimensions, a first dimension of the array being associated with the first direction component, a second dimension of the array being associated with the second direction component, and the third dimension being associated with a transfer function representative.

The multi dimensional transfer function database may be denoted as tensor X. The output of the PARAFAC decomposition is a set of basis functions $c_1 \ldots c_N$ and their corresponding gain factors $a_1 \ldots a_I$ of the first set of gain factors and their corresponding gain factors $b_1 \ldots b_J$ of the second set of gain factors.

Any transfer function representative h associated with a value of the first direction component and a value of the second direction component in the multi dimensional transfer function database can be expressed as a linear combination of weighted basis functions $c_1 \ldots c_N$, the basis functions being weighted with corresponding gain factors of the set of first gain factors associated with the respective value of the first direction component and corresponding gain factors of the set of second gain factors associated with the respective value of the second direction component.

For instance, the transfer function representative h(i,j) for a given row i and column j in the multi dimensional transfer function database, wherein i is associated with a value of the first direction component and j is associated with a value of the second direction component, can be expressed as follows:

$$h(i,j)=a_1(i)\cdot b_1(j)\cdot c_1+a_2(i)\cdot b_2(j)\cdot c_2+\ldots+a_N(i)\cdot b_N(j)\cdot c_N+e(i,j)$$

with e(i, j) representing an error term of error tensor E. Thus, any transfer function representative h(i,j) in X can be constructed or estimated as a linear combination of the N vectors $c_k$.

The Tucker-3 model differs from the PARAFAC model by the presence of a core array in the model structure. To reflect this addition, the equation above can be re-written as $$h(i,j)=f_1(i,j)\cdot c_1+f_2(i,j)\cdot c_2+\ldots+f_N(i,j)\cdot c_N+e(i,j)$$

where $$f_1(i,j)=\sum_{p=1}^{P}\sum_{q=1}^{Q} g_{pq1}a_p(i)b_q(j)$$

$$f_2(i,j)=\sum_{p=1}^{P}\sum_{q=1}^{Q} g_{pq2}a_p(i)b_q(j)$$

$$\ldots$$

$$f_N(i,j)=\sum_{p=1}^{P}\sum_{q=1}^{Q} g_{pqN}a_p(i)b_q(j)$$

The terms P and Q in the summations of the $f_n$ correspond to the number of components in the first mode (azimuth) for P and the second mode (elevation) for Q. Note that in Tucker models the number of components does not have to be the same in the three modes. Also, $g_{pqn}$ (where n=1, . . . , N) is a scalar of the Tucker-3 core array, which in this example case is a three-way array of size P×Q×N (that is, P components for azimuth, R components for elevation and N components for basis functions.

In one embodiment of the described second method, the decomposing is one out of: a PARAFAC decomposition; and a Tucker decomposition.

The Tucker decomposition may represent a Tucker-N decomposition with N≥2.

In one embodiment of the described first method, determining the at least one weighting factor for each basis function comprises for a respective basis function: determining a first weighting factor being associated with the value of the first direction component of the direction based on the set of first gain values for the respective basis function, and determining a second weighting factor being associated with the value of the second direction component of the direction based on the set of second gain values for the respective basis function.

Based on the separate first set of gain factors and second set of gain factors, a first and a second weighting factors are determined for a respective basis function, wherein the first weighting factor may be determined based on a gain value of the first set of gain values being associated with the respective basis function and the value of the first direction component, and wherein the second weighting factor may be determined based on a gain value of the second set of gain values being associated with the respective basis function and the value of the second direction component.

In one embodiment of the described first method, the determining the first weighting factor is based on one out of: selecting a gain value of the first set of gain values being associated with the value of the first direction component for the respective basis function, determining an interpolated gain value based on the first set of gain values being associated with the value of the first direction component for the respective basis function; and determining an extrapolated gain value based on the first set of gain values being associated with the value of the first direction component for the respective basis function.

It is assumed, that the gain factors of the first set of gain factors are associated with different values of the first direction component. For instance, the first set of gain factors is associated with I different direction values $d_1^1 \ldots d_I^1$ of the first direction component. The superscript[1] denotes that these direction values are associated with the first direction component. Thus, the second set of gain factors may be associated with J different values $d_1^2 \ldots d_J^2$ of the second direction component denoted by superscript[2].

In case the value of the first direction component is not exactly represented by one of the I different values of the first direction component, a gain value of the first set of gain values being associated with one direction value of the I direction values being the closest to the value of the first direction component can be selected. This gain value may represent a gain value of the corresponding first subset of gain values corresponding to the respective basis function.

Furthermore, as an example, the determining the first weighting factor may comprise determining an interpolated gain value based on the first set of gain values being associated with the value of the first direction component for the respective basis function.

For instance, this interpolating may comprise determining two neighbored direction values $d_x^1$ $d_{x+1}^1$ associated with the respective k-th basis function, wherein the value (denoted as v) of the first direction component lies between the neighbored direction values:

$$d_x^1 < v < d_{x+1}$$

Then, the first weighting factor may be determined based on an interpolation between two gain factors $a_x^1$ $a_{x+1}^1$ associated with the neighbored direction values $d_x^1$ $d_{x+1}^1$. For instance, a linear interpolation may be used.

In case the value of the first direction component is less than the lowest direction value (e.g. $d_1^1$) or the value of the first direction component is higher than the highest direction value (e.g. $d_I^1$), the first weighting factor may be determined based on an extrapolation based on the first set of gain values for the respective basis function.

Accordingly, a first weighting factor can be determined for any value of the first direction component, even if the value of the first direction component is not represented exactly by one of the different direction values $d_1^1 \ldots d_I^1$ of the first direction component.

In one embodiment of the described first method, the determining the second weighting factor is based on one out of: selecting a gain value of the second set of gain values being associated with the value of the second direction component for the respective basis function, determining an interpolated gain value based on the second set of gain values being associated with the value of the second direction component for the respective basis function, and determining an extrapolated gain value based on the second set of gain values being associated with the value of the second direction component for the respective basis function.

The explanations given above regarding determining the first weighting factor also hold for determining this second weighting factor.

For example, a second weighting factor can be determined for any value v2 of the second direction component, even if the value of the second direction component is not represented exactly by one of the different direction values $d_1^2 \ldots d_J^2$ of the second direction component.

Based on the determined first weighting factors $w_k^1$ associated with each of the basis functions and on the determined second weighting factors $w_k^2$ associated with each of the basis functions, a transfer function representative can be determined for the given direction based on a linear combination of correspondingly weighted basis functions. For example, a transfer function representative can be written as $$h(v1, v2) = w_1^1 \cdot w_1^2 \cdot c_1 + w_2^1 \cdot w_2^2 \cdot c_2 + \ldots + w_N^1 \cdot w_N^2 \cdot c_N = \sum_{k=1}^{N} w_k^1 \cdot w_k^2 \cdot c_k.$$

In one embodiment of the described first method, determining the at least one weighting factor for each basis function comprises for a respective basis function: determining a combined weighting factor based on a first gain factor, selected from the first set of gain factors and on a second gain factor, selected from the second set of gain factors, the first gain factor being associated with the value of the first direction component and the second gain factor being associated with the value of the second direction component of the direction for the respective basis function.

For instance, a transfer function representative can be written as $$h(v1, v2) = \sum_{k=1}^{N} w_k(v1, v2) \cdot c_k,$$

wherein $w_k$ (v1, v2) represents the combined weighting factor associated with the k-th basis function.

For instance, this combined weighting factor $w_k$(v1, v2) may be determined by multiplying the first and the second weighting factors $w_k^1$ and $w_k^2$, wherein these first and second weighting factors may be determined as mentioned above with respect to the preceding embodiments.

In one embodiment of the described first method, the determining at least one weighting factor for the respective basis function is further based on a third set of gain factors. The gain factors of this third set of gain factors may be associated for example with specific individual transfer characteristics.

Thus, an additional dimension can be introduced by means of the third set of gain factors. The specific individual transfer characteristics may represent individual characteristics for several individual HRTF sets.

In one embodiment of the described first method, the direction is further associated with a value of a third direction component, wherein gain factors of one of the at least one further set of gain factors are associated with the third direction component.

In one embodiment of the described first method, gain factors of one of the at least one further set of gain factors are associated with specific individual transfer characteristics.

In one embodiment of the described first method, gain factors of one of the at least one further set of gain factors associate with specific types of reflecting surfaces.

For instance, the at least one weighting factor for each basis function may be determined based on the first set of gain factors, associated with the first direction component, based on the second set of gain factors, associated with the second direction component, and on the at least one of the at least one further set of gain factors being associated with specific types of reflecting surfaces. Thus, the at least one weighting factor determined for each basis functions may depend on the direction and a specific type of a respective surface. Accordingly, this may be used for modelling the respective reflecting surface. For instance, the respective reflecting surface may represent the surface of a specific wall, of a floor, or of any other surface.

In one embodiment of the described first method, the first method comprises performing, for each input signal of at least one input signal, said determining the at least one weighting factor for each basis function of a set of basis functions for each direction of at least one direction associated with the respective input signal.

One of this at least one direction associated with the respective input signal may be selected. Then, for this selected direction, for each basis function of the set of basis functions at least one weighting factor is determined, as explained above.

Afterwards, it may be checked whether there exists a further direction associated with the respective input signal, and if there is a further direction, the method selects this direction and repeats, for this selected direction, determining for each basis function of the set of basis functions at least one weighting factor.

Accordingly, for each direction associated with each of the input signals at least one weighting factor can be determined for each basis function of the set of basis functions.

In one embodiment of the described first method, the method comprises for each input signal of the at least one input signal: filtering the respective input signal, for each direction associated with the respective input signal, with a filter function based on the set of basis functions and on the determined at least one weighting factors associated with each of the basis functions for the respective direction of the respective input signal.

This respective input signal is filtered by means of a filter function based on the set of basis functions $c_1 \ldots c_N$ and on the determined at least one weighting factors associated with each of the basis functions for the respective direction.

For instance, the filtered signals associated with the at least one direction of the respective input signal may be combined to an output signal. As an example, at least one of the at least one direction may be associated with a direction of a reflection path in 3D auditory space. Thus, a reflection can be modeled as a virtual speaker at the reflection point being associated with a respective signal. Since reflections are generated by the same input signal as the signal on the direct path, both the reflections and the direct signal are associated with the same input signal.

For instance, modeling a specific reflection may be performed by means at least one of the at least one further set of gain factors, wherein each of said at least one of the at least one further set of gain factors may be associated with a specific type of a respective reflecting surface. Thus, determining the at least one weighting factor for each basis function may be determined based on the first set of gain factors, associated with the first direction component of a respective direction, based on the second set of gain factors, associated with the second direction component of the respective direction, and on said at least one of the at least one further set of gain factors.

Furthermore, the at least one input signal may represent a plurality of input signals being associated with different 3D sound sources. Thus, for each of the different 3D sound sources a direct path component can be modeled, wherein the direct path is associated with a respective direction, and reflections of each of the sound sources in the 3D auditory can be modeled. Afterwards, the filtered signals can be combined to one output signal, e.g. by summing the filtered signals.

In one embodiment of the described first method, the filter function corresponds to a weighted linear combination of the basis functions, wherein each basis function of the set of basis functions is weighted by the determined at least one weighting factor associated with the respective basis function for the respective direction of the respective input signal.

For example, a filter function can be written as $$h(v1, v2) = \sum_{k=1}^{N} w_k(v1, v2) \cdot c_k,$$

wherein $w_k$ (v1, v2) denotes the combined weighting factor associated with the k-th basis function, and v1 represents the value of the first direction component and v2 represents the value of the second direction component.

For instance, filtering a respective input function with a filter function may be performed based on a convolution.

In one embodiment of the described first method, wherein said filtering the respective input signal comprises for each basis function of the set of basis functions: determining, for each direction of the respective input signal, a scaled signal on the basis of the respective input signal and the at least one weighting factor associated with the respective basis function and the respective direction.

For instance, the scaled signal may be determined by multiplying the respective input signal with the at least one weighting factor associated with the respective basis function and the respective direction.

Assuming L directions being associated with the respective input signal, L scaled signals are determined for each of the basis functions. In order to perform the filtering, each of the L scaled signals may be convolved with the respective basis functions. Afterwards, all the convolved signals may be combined in order to generate an output signal.

As an alternative, for instance, the L scaled signals associated with one basis function may be combined before being convolved with the respective basis function. Combining the L scaled signals may for example comprise determining the sum of the signals. Thus, only one convolution is necessary for each of the basis functions. Afterwards, the convolved signals of the basis functions may be combined in order to generate an output signal.

In one embodiment of the described first method, the method comprises introducing a time delay associated with at least one of the scaled signals.

For instance, this time delay may be introduced before or after the scaling operation.

Furthermore, a time delay may be associated with a direction associated with an input signal. Thus, the scaled signals associated with this direction of this input signal may be delayed by a predetermined value. For instance, this predetermined value may correspond to the delay of a reflection path compared to the direct path. As an example, the respective input may be delayed with the predetermined value before the scaling operations being associated with this direction and this input signal are performed. Accordingly, only one delay element is necessary for one direction of one input signal.

In one embodiment of the described first method, the method comprises for each basis function of the set of basis functions: determining a combined scaled signal on the basis of at least one scaled signal of the scaled signals being associated with the respective basis function; and determining a filtered combined signal on the basis of a convolution of the respective basis function and the respective combined scaled signal.

For instance, with respect to the first basis function $c_1$, the combined scaled signal may be determined based on each scaled signal associated with the first basis function, even for scaled signals associated with different directions and/or associated with different input signals. Of course, a delay may be introduced to at least one of the scaled signals, as explained above. Accordingly, only one convolution is necessary with respect to the first basis function $c_1$. The same holds for the remaining basis functions.

Consequently, only N convolutions are necessary regardless of the number of directions and regardless of the number of input signals. For instance, every time a new virtual source with a new direction is added, N additional multiplications are needed, but the number of convolutions remains constant.

In one embodiment of the described first method, the method comprises determining an output signal based on a combination of the filtered combined signals.

For instance, each channel may be filtered with at least one HRTF such that when combined into left and right channels and played over headphones, the listener senses that a plurality of virtual sound sources are positioned in the 3D auditory space. For example, the method may be applied to the left channel and to the right channel of a headphone, thereby enhancing a virtual surround sound.

The features of the present invention and of its exemplary embodiments as presented above shall also be understood to be disclosed in all possible combinations with each other.

It is to be noted that the above description of embodiments of the present invention is to be understood to be merely exemplary and non-limiting.

Further aspects of the invention will be apparent from and elucidated with reference to the detailed description presented hereinafter.

DETAILED DESCRIPTION OF EXEMPLARY EMBODIMENTS OF THE INVENTION

In the following detailed description, exemplary embodiments of the present invention will be described in the context of exemplary methods and apparatuses.

Figure 1:
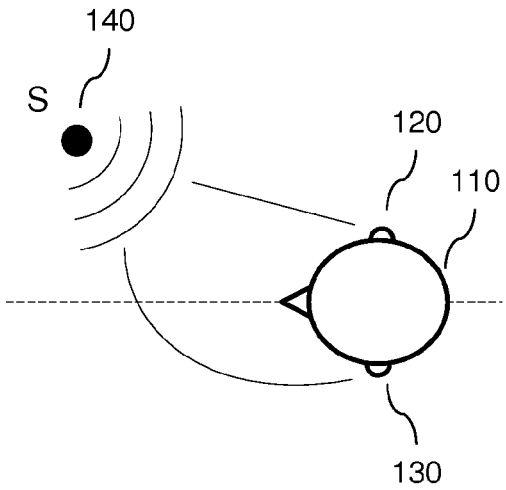
FIG. 1 is a schematic representation of a HRTF.
Figure 2A:
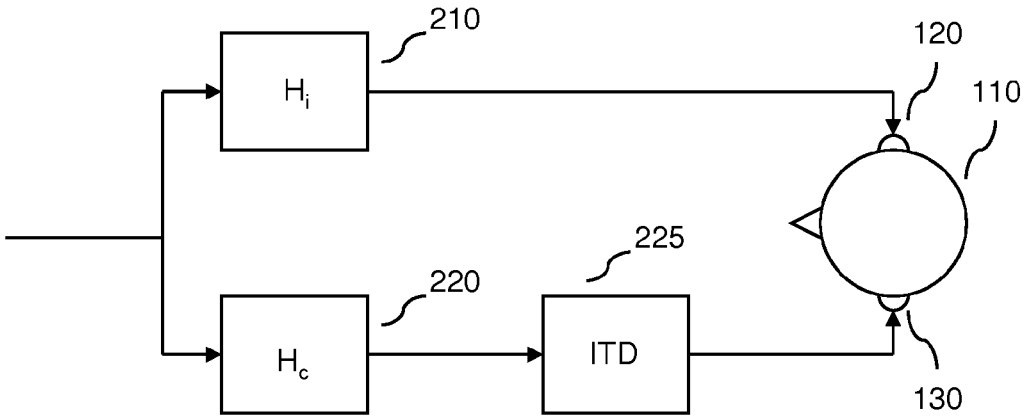
FIG. 2*a* is a schematic representation of a single virtual source.
Figure 2B:
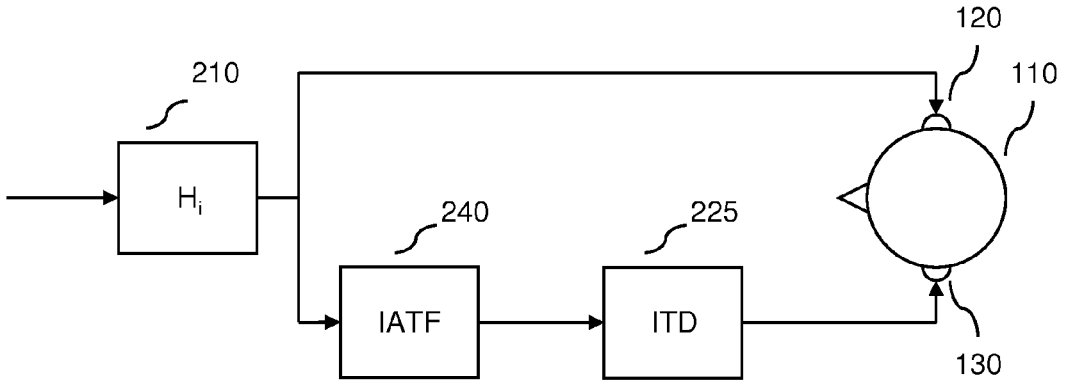
FIG. 2*b* is a another schematic representation of a single virtual source.
Figure 3A:
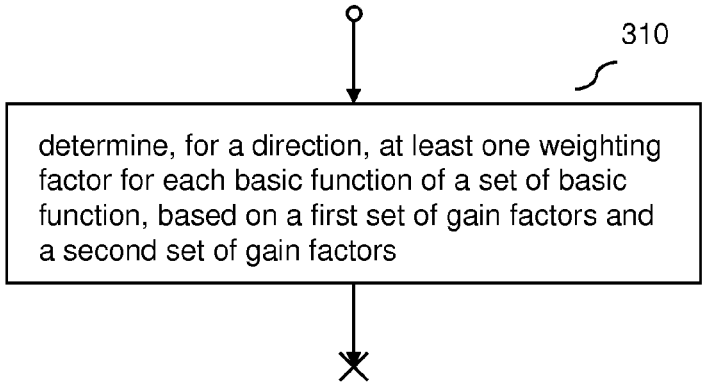
FIG. 3*a* is a flow chart illustrating a first exemplary method.

FIG. 3*a* is a flow chart which illustrates a first exemplary method.

This method comprises determining 310, for a direction, at least one weighting factor for each basis function of a set of basis functions based on a first set of gain factors and a second set of gain factors.

The direction is associated with a value of a first direction component and with a value of a second direction component, and each of the basis functions is associated with an audio transfer characteristic. For instance, this audio transfer characteristic may be associated with a transfer function representative. For instance, this transfer function representative may be an unvarying frequency or impulse response characteristic. Furthermore, for instance, each of the set of basis functions may represent a filter function being associated with the respective audio transfer characteristic. As an example, such a filter function may be represented by a set of filter coefficients, but any other well suited representation may also be used.

The first set of gain factors is associated with a first direction component and the second set of gain factors is associated with a second direction component. For instance, the first direction component and the second direction component may represent orthogonal components.

The determined at least one weighting factor for each basis function may be used to construct a filter being associated with the respective direction. For instance, a filter may be formed by multiplying each basis function with the respective at least one weighting factor and by combining the weighted basis functions.

The direction may be associated with the direction of an arrival of an input signal. Thus, the set of basis functions and the determined at least one weighting factor for each basis function may be used to construct a filter for filtering an input signal in order to determine a filtered signal according to a virtual source direction in a three-dimensional (3D) auditory space. Accordingly, a virtual sound source in a 3D auditory space can be provided based on the set of basis functions and the determined at least one weighting factor for each basis function.

The set of first gain factors, the set of second gain factors and the set of basis functions may be considered as a multi-way array of data enabling construction of a filter function associated with a freely choosable direction. For instance, this filter database may be generated based on decomposing a given multi-dimensional transfer function database into the set of first gain factors being associated with the first direction component, the set of second gain factors being associated with the second direction component and the set of basis functions. As an example, this multi-dimensional transfer function database may represent a given multi-dimensional HRTF filter database. Thus, such multi-way array of data may be used to construct a HRTF filter for a freely choosable direction. A possible decomposition for generating the multi-way array will be exemplarily described with respect to FIG. 4*b*.

Figure 3B:
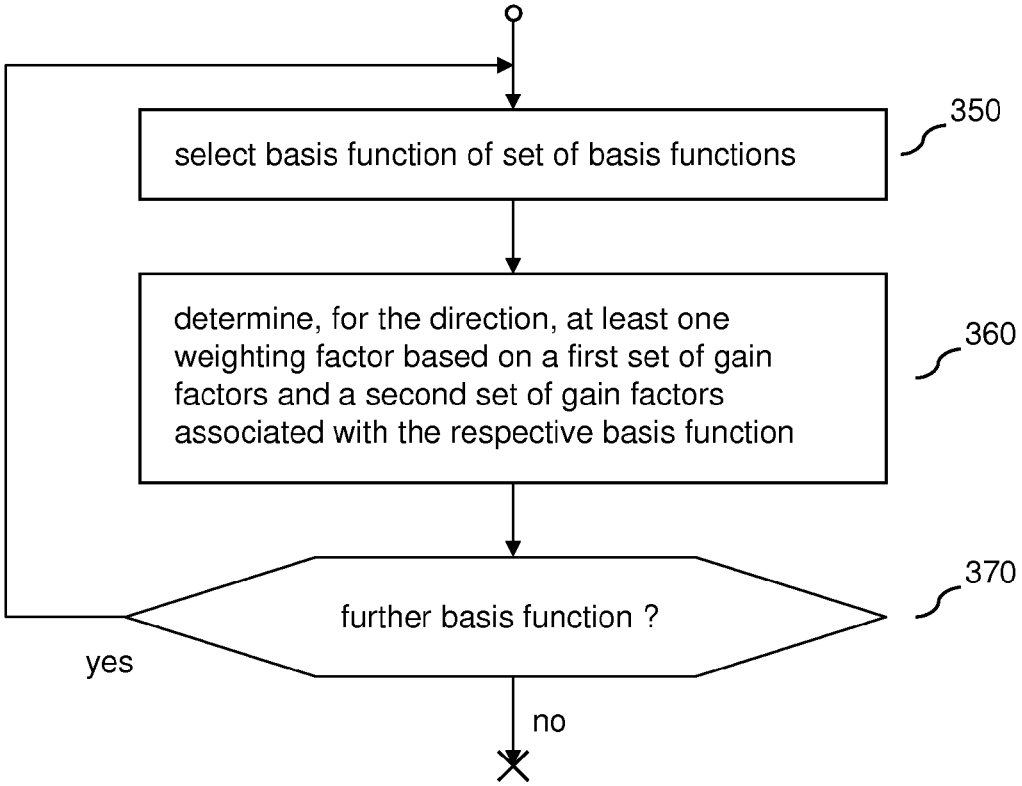
FIG. 3*b* is a flow chart illustrating a second exemplary method.

FIG. 3*b* is a flow chart which illustrates a second exemplary method, which is based on the first exemplary method depicted in FIG. 3*a*.

This second exemplary method comprises selecting 350 one basis function of the set of basis functions. Then, for the respective basis function at least one weighting factor is determined (indicated by reference sign 360) for the direction being associated with the value of the first direction component and with the value of the second direction component based on the first set of gain factors and the second set of gain factors, as explained with respect to the first exemplary method.

Afterwards, it is checked whether there is a further basis function in the set of basis function, indicated by reference sign 370. If there is a further basis function, the method repeats and selects this basis function, so that at least one weighting factor can be determined for this basis function. In this way, at least one weighting factor can be determined for each basis function of the set of basis functions.

As an exemplary alternative optional embodiment, determining the at least one weighting factor for each basis function may be performed in parallel.

Figure 3C:
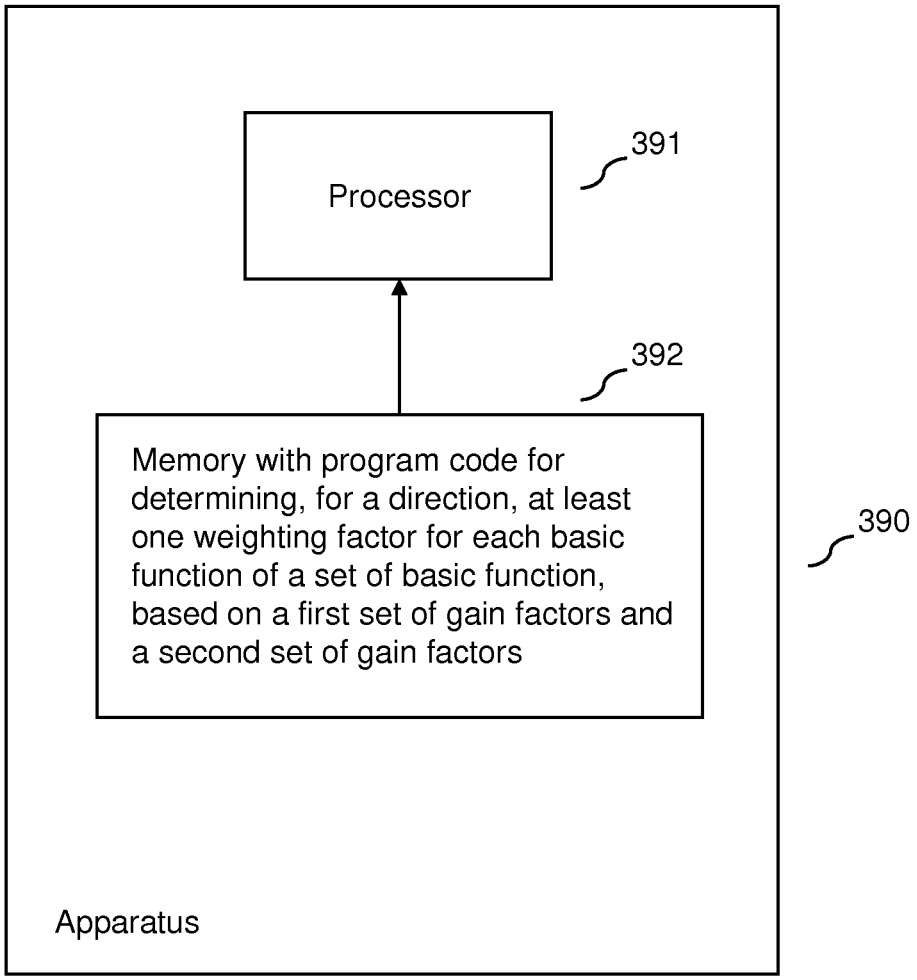
FIG. 3*c* is a schematic block diagram of an exemplary first apparatus.

As depicted in FIG. 3*c*, apparatus 390 comprises a processor 391 and a memory 392. Memory 392 stores computer program code for performing the first exemplary method depicted in FIG. 3*a* and any other described methods based on this first exemplary method. In addition, memory 392 may store computer program code implemented to realize other functions, as well as any kind of other data. Processor 391 is configured to execute computer program code stored in memory 392 in order to cause the apparatus to perform desired actions.

Figure 4A:
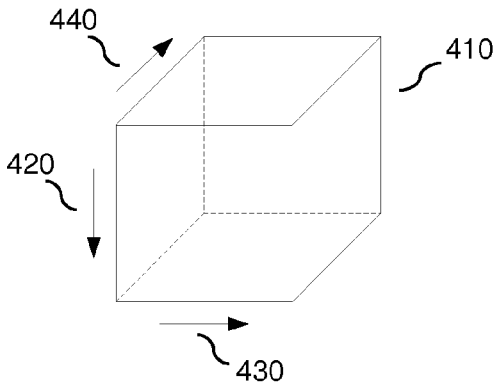
FIG. 4*a* is a schematic representation of an exemplary multi-dimensional transfer function database.
Figure 4B:
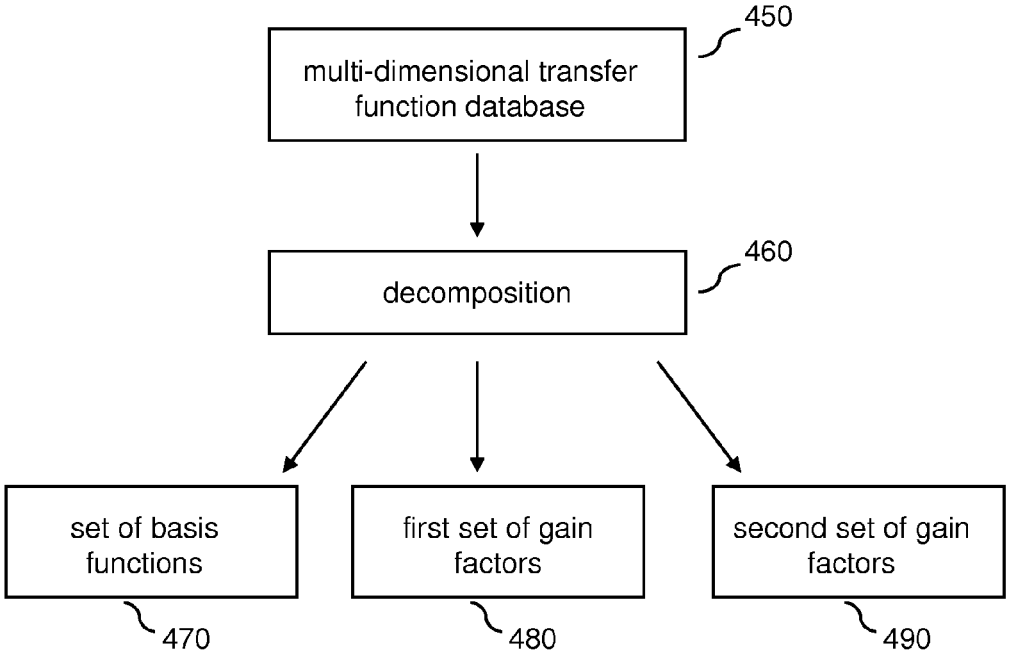
FIG. 4*b* is an exemplary decomposition.

FIG. 4*a* is an exemplary multi-dimensional transfer function database 410 which can be used for a decomposition as exemplarily depicted in FIG. 4*b*. This exemplary multi-dimensional filter database 410 is arranged in a three way array, wherein a first dimension 420 of the array may be associated with a first direction component, a second dimension 430 of the array may be associated with a second direction component and the third dimension 440 may be associated with a transfer function representative. For instance, the transfer function representative associated with the third dimension 440 may be an impulse response or the frequency response corresponding to a direction of arrival in a 3D auditory space, wherein the direction may be described by the first direction component and the second direction component.

Thus, the multi-dimensional transfer function database 410 comprises for any given value of the first direction component and for any given value of the second direction component stored in the database 410 a corresponding transfer function representative.

For instance, the first direction component may represent a dimension for azimuth and the second direction component may represent a dimension for elevation, but any other well-suited direction components may be applied.

It has to be understood that any other kind of multi-dimensional transfer function database may be applied, for instance a two way (array or a four way array. As an example, the two way array may comprise a first dimension associated with a position and a second dimension associated with a transfer function representative.

The direction is at least associated with a value of a first direction component and a value of a second direction component. For instance, the direction may be associated with at least one value being associated with at least one further direction component. Accordingly, for instance, three direction components, four directions components, or more than four directions components may be used. Consequently, determination of the at least one weighting factor may further based on at least one further set of gain factors, each of the further set of gain factors being associated with one of the at least one further direction component.

For instance, the first and second direction components and the optional at least one further direction component may represent spherical coordinates.

As an example, a first direction component may represent an azimuth dimension, a second direction component may represent an elevation dimension, and a third direction component may represent a distance between a listener and a position in the 3D space.

For instance, employing also a direction component to represent the distance between a listener and a position in the 3D space may be beneficial for example in near-field HRTF rendering, which may be used to create virtual sound sources close to the listener head (e.g. in range of 0.1 to 1 m) in personal 3D displays. Then, as an example, the above mentioned use of azimuth, elevation and distance as a first, second and third direction component, respectively, may be applied, but using only two modes azimuth and distance may also be applied.

Furthermore, as another example, the first and second direction components and the optional at least one further direction component may represent Cartesian coordinates, e.g. like 'x-y-z coordinates', such that the x-coordinate, the y-coordinate and the z-coordinate may represent the first, second and third direction component. Of course, only two dimensions of Cartesian coordinates may be used. As an example, Cartesian coordinates ("x-y-z" coordinates) may be used to determine a position in the 3D space with respect to the position of a listener.

For instance, the multi-dimensional transfer function database depicted in FIG. 4*a* may represent a Head Related Impulse Response (HRIR) database or a Head Related Transfer Function (HRTF) database for a given user or for an artificial head arranged in a three way matrix.

FIG. 4*b* depicts an exemplary decomposition 460 of a multi-dimensional transfer function database 450 into a set of basis functions 470 associated with audio transfer characteristics, a first set of gain factors 480, associated with a first direction component, and a second set of gain factors 490, associated with a second direction component.

Figure 4C:
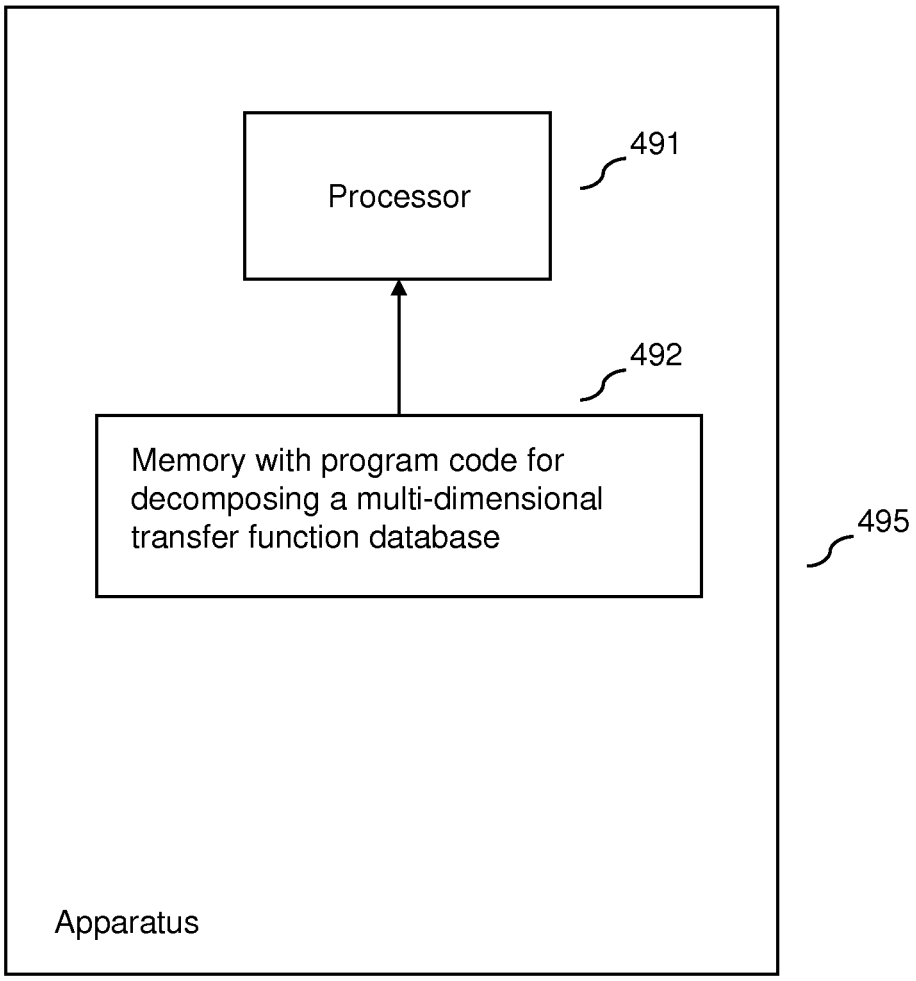
FIG. 4*c* is a schematic block diagram of an exemplary second apparatus.

As depicted in FIG. 4*c*, apparatus 495 comprises a processor 491 and a memory 492. Memory 492 stores computer program code for performing the decomposing of the multi-dimensional transfer function database. In addition, memory 492 may store computer program code implemented to realize other functions, as well as any kind of other data. Processor 491 is configured to execute computer program code stored in memory 492 in order to cause the apparatus to perform desired actions.

The decomposition 460 may be performed by means of a multi-way analysis, wherein the first set of gain factors 480, the second set of gain factors 490 and the set of basis functions 470 represent a multi-linear model configured to represent the multi-dimensional transfer function 450. For instance, PARAFAC and Tucker-2, Tucker-3 or higher order Tucker models, PARATUCK-2 or any other (related) multiway model handling at least three modes may be used as multi-linear models for a multi-way analysis of the multi-dimensional transfer function database 450, but any other well-suited multi-way analysis may also be used.

The basis functions of the set of basis function 470 may represent orthogonal or non-orthogonal basis functions. The number of basis functions may represent a design parameter, enabling a trade-off between complexity and exactness.

Figure 5:
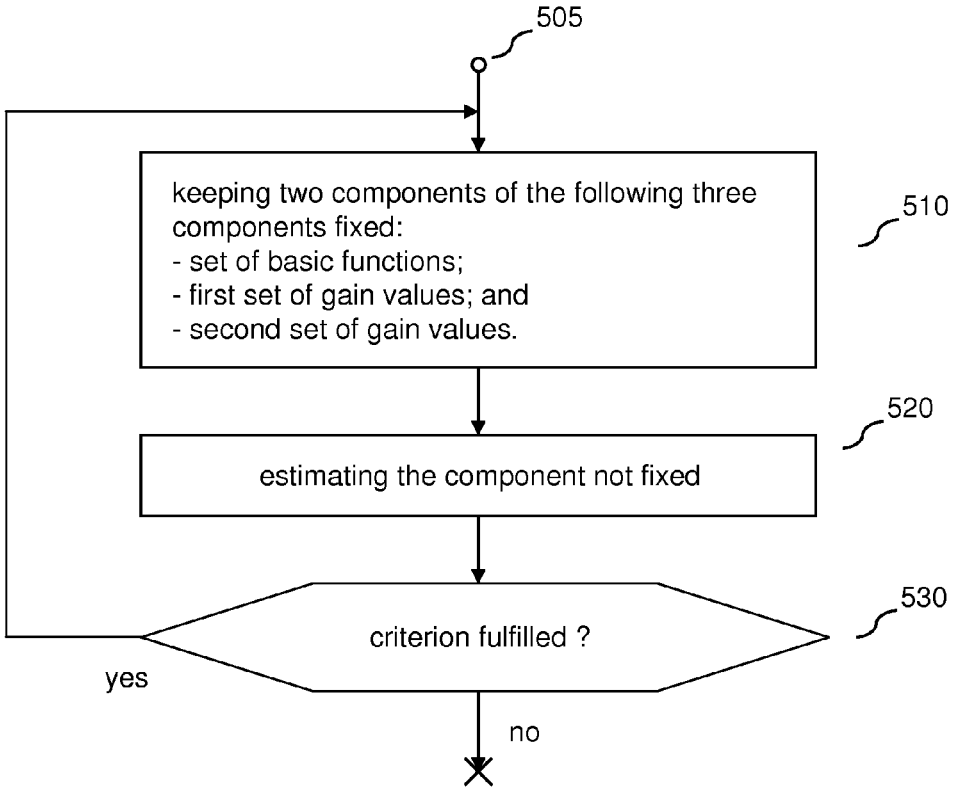
FIG. 5 is a flow chart illustrating an exemplary decomposition.

The algorithm to find the decomposition may be performed in an iterative way and may be constrained in different ways. For instance, assuming that the transfer function representative in the multi-dimensional transfer function database represents an impulse response, the impulse response of the multi-dimensional transfer function database may be reduced to minimum phase impulse responses and time-delays and can then be given as an input to the decomposition process. As another example, the decomposition may be performed on the transfer functions or only on the magnitude response of the transfer functions. The impulse response may represent a PRIR and the transfer function may represent a HRTF. A flowchart illustrating an exemplary decomposition of a multi-dimensional transfer function database is depicted in FIG. 5. The explanations given above also holds for this flowchart depicted in FIG. 5.

According to the decomposition 460, the first set of gain factors 480 may comprise a plurality of first subsets of gain factors, each subset of the plurality of first subsets of gain factors being associated with one basis function of the set of basis functions, wherein each subset of the plurality of first subsets comprises gain factors associated with different values of the first direction component.

Similarly, the second set of gain factors 490 may comprise a plurality of second subsets of gain factors, each subset of the plurality of second subsets of gain factors being associated with one basis function of the set of basis functions, wherein each subset of the plurality of second subsets comprises gain factors associated with different values of the second direction component.

For instance, the set of basis functions may comprise N basis functions, wherein each of the N basis functions comprises n components. Thus, each basis function may be represented by means of a vector $c_k=[c_k(1)\ c_k(2)\ \ldots\ c_k(n)]$ wherein $k\epsilon\{1\ldots N\}$ holds.

Furthermore, as an example, each first subset of gain factors may be represented by means of a vector $a_k=[a_k(1)\ a_k(2)\ldots a_k(I)]$ comprising I gain values being associated with different values of the first direction component for the k-th basis function $c_k$, and each second subset of gain factors may be represented by means of a vector $b_k=[b_k(1)\ b_k(2)\ldots b_k(J)]$ comprising J gain values being associated with different values of the first direction component for the k-th basis function $c_k$.

Figure 4D:
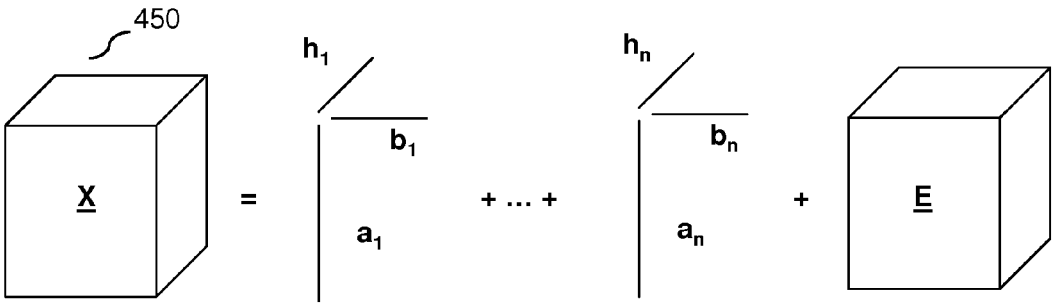
FIG. 4*d* is a schematic representation of an exemplary multi-way decomposition.

This exemplary notation of the gain factors $a_k$ associated with the first set of gain factors, the gain factors $b_k$ associated with the second set of gain factors and the basis functions $c_k$ will now be used for explaining an exemplary PARAFAC decomposition of the multi dimensional transfer function database 450 as depicted in FIG. 4*d*.

The multi dimensional transfer function database 450 may be denoted as tensor X. The output of the PARAFAC decomposition is a set of basis functions $c_1\ldots c_N$ and their corresponding gain factors $a_1\ldots a_I$ of the first set of gain factors and their corresponding gain factors $b_1\ldots b_J$ of the second set of gain factors.

Any transfer function representative h associated with a value of the first direction component and a value of the second direction component in the multi dimensional transfer function database 450 can be expressed as a linear combination of weighted basis functions $c_1\ldots c_N$, the basis functions being weighted with corresponding gain factors of the set of first gain factors associated with the respective value of the first direction component and corresponding gain factors of the set of second gain factors associated with the respective value of the second direction component.

For instance, the transfer function representative h(i,j) for a given row i and column j in the multi dimensional transfer function database 450, wherein i is associated with a value of the first direction component and j is associated with a value of the second direction component, can be expressed as follows:

$$h(i,j)=a_1(i)\cdot b_1(j)\cdot c_1+a_2(i)\cdot b_2(j)\cdot c_2+\ldots+a_N(i)\cdot b_N(j)\cdot c_N+e(i,j)$$

with e(i, j) representing an error term of error tensor E. Thus, any transfer function representative h(i,j) in X can be constructed or estimated as a linear combination of the N vectors $c_k$.

FIG. 5 depicts an exemplary method of decomposing a multi dimensional transfer function database.

It is assumed that a starting set of the set of basis functions, the set of first gain values and the set of second gain values is given before starting the decomposition (indicated by reference sign 505 in FIG. 5).

The set of basis functions may represent a first component, the first set of gain factors may represent a second component and the second set of gain factors may represent a third component.

Two of these three components are fixed, as indicated by reference sign 510 in FIG. 5.

Then the remaining non-fixed component is estimated 520 by keeping the other components fixed.

This estimation may be subjected to constraints, for example to orthogonality or non-negativity, and it can be adapted for specific error criterions, for example weighted least squares.

After this estimation of the non-fixed component it is determined whether an exit criterion is fulfilled or not (reference sign 530). For example, this exit criterion may represent a minimum mean squared error criterion or a least minimum squared error criterion or any other well-suited criterion applied to the multi-way array comprising the set of basis functions, the first set of gain factors and the second set of gain factors with respect to the multi dimensional transfer function database. For instance, assuming that the exemplary PARAFAC decomposition depicted in FIG. 4*d* is applied, this exit criterion may be applied to error tensor E.

The exemplary iterative algorithm depicted in FIG. 5 may represent an Alternating Least Squares (ALS) algorithm A detailed description of the Alternating Least Squares principle and its application to the PARAFAC and Tucker-3 decomposition techniques may be found for example in Age Smilde, Rasmus Bro and Paul Geladi, "Multi-way Analysis, Application in the chemical sciences", John Wiley and Sons, 2004 (pages 113-124). For instance, any other well suited iterative algorithm may be used for estimating the first set of gain factors, the second set of gain factors and the set of basis functions. As an example, an iterative Recursive Least Squares (RLS) algorithm or an iterative Least Minimum Squares (LMS) algorithm or derivatives thereof may be applied.

Figure 6A:
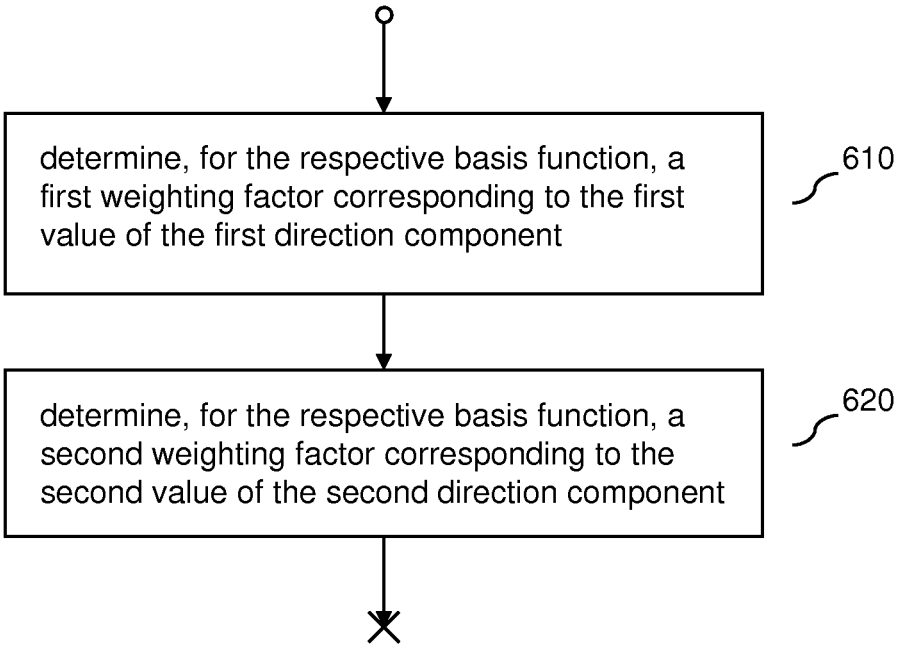
FIG. 6*a* is a flow chart illustrating a third exemplary method.

FIG. 6*a* depicts a third exemplary method of determining weighting factors for a basis function, which can be used for the first or second exemplary method depicted in FIGS. 3*a* and 3*b*, respectively, in order to determine the at least one weighting factor associated with each basis function.

Based on the separate first set of gain factors and second set of gain factors, a first and a second weighting factors are determined.

This third exemplary method comprises, for the respective basis function, determining a first weighting factor being associated with the value of the first direction component of the direction, indicated by reference sign 610. That is, the first weighting factor is associated with the value of the first direction.

For instance, this may comprise selecting a gain value of the first set of gain values being associated with the value of the first direction component.

It is assumed, that the gain factors of the first set of gain factors are associated with different values of the first direction component. For instance, the first set of gain factors is associated with I different direction values $d_1^1 \ldots d_I^1$ of the first direction component. The superscript[1] denotes that these direction values are associated with the first direction component. Thus, the second set of gain factors may be associated with J different values $d_1^2 \ldots d_J^2$ of the second direction component denoted by superscript[2].

In case the value of the first direction component is not exactly represented by one of the I different values of the first direction component, a gain value of the first set of gain values being associated with one direction value of the I direction values being the closest to the value of the first direction can be selected. This gain value may represent a gain value of the corresponding first subset of gain values corresponding to the respective basis function.

Furthermore, as an example, the determining the first weighting factor of the third exemplary method depicted in FIG. 6*a* may comprise determining an interpolated gain value based on the first set of gain values being associated with the value of the first direction component for the respective basis function. This will be explained in view of the exemplary first subset of gain factors depicted in FIG. 7, this first subset being associated with a k-th basis function.

Figure 7:
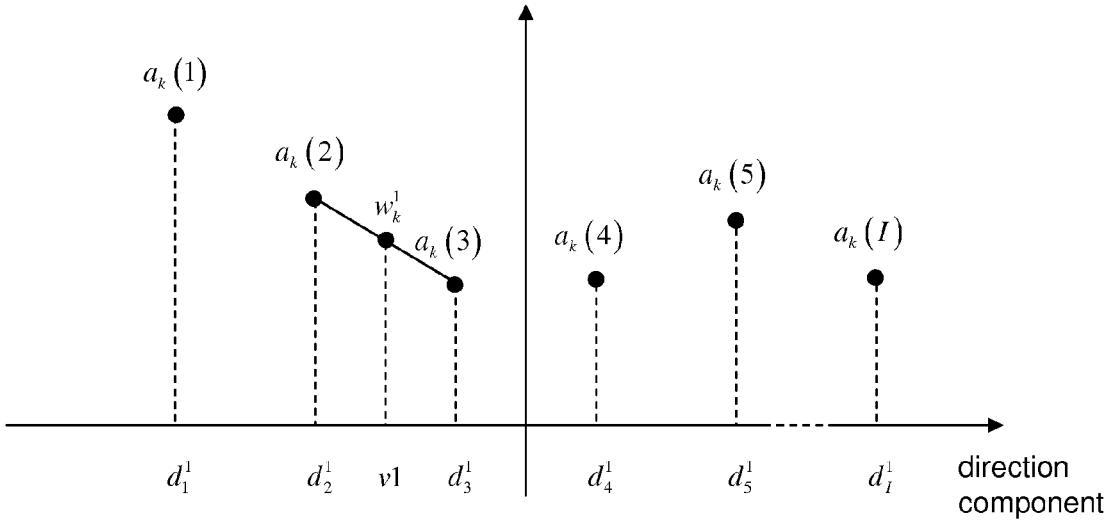
FIG. 7 is a schematic representation of an exemplary interpolation.

For instance, this interpolating may comprise determining two neighbored direction values $d_x^1\ d_{x+1}^1$, wherein the value (denoted as v) of the first direction component lies between the neighbored direction values: $d_x^1 < v < d_{x+1}^1$ Then, the first weighting factor can be determined based on an interpolation between two gain factors $a_x^1\ a_{x+1}^1$ associated with the neighbored direction values $d_x^1\ d_{x+1}^1$. In FIG. 7, an example for such an interpolation is presented for a value v1 of the first direction component being arranged between the neighbored direction values $d_2^1\ d_3^1$, wherein the first weighting factor $w_k^1$ is determined based on an interpolation between corresponding gain factors $a_2^1\ a_3^1$ of the first subset of gain values corresponding to the k-th basis function. Some other interpolation method could be used as well e.g. Lagrange interpolation.

In case the value of the first direction component is less than the lowest direction value (e.g. $d_1^1$) or the value of the first direction is higher than the highest direction value (e.g. $d_I^1$), the first weighting factor may be determined based on an extrapolation based on the first set of gain values for the respective basis function.

Accordingly, a first weighting factor can be determined for any value of the first direction component, even if the value of the first direction component is not represented exactly by one of the different direction values $d_1^1 \ldots d_I^1$ of the first direction component.

Furthermore, this third exemplary method depicted in FIG. 6*a* comprises, for the respective basis function, determining a second weighting factor being associated with the value of the second direction component of the direction, indicated by reference sign 620. That is, the second weighting factor is associated with the second value of the first direction.

The explanations given above regarding determining the first weighting factor also hold for determining this second weighting factor.

Accordingly, a second weighting factor can be determined for any value v2 of the second direction component, even if the value of the second direction component is not represented exactly by one of the different direction values $d_1^2 \ldots d_J^2$ of the second direction component.

Based on the determined first weighting factors $w_k^1$ associated with each of the basis functions and on the determined second weighting factors $w_k^2$ associated with each of the basis functions, a transfer function representative can be determined for the given direction based on a linear combination of correspondingly weighted basis functions. For example, a transfer function representative can be written as $$h(v1, v2) = w_1^1 \cdot w_1^2 \cdot c_1 + w_2^1 \cdot w_2^2 \cdot c_2 + \ldots + w_N^1 \cdot w_N^2 \cdot c_N = \sum_{k=1}^{N} w_k^1 \cdot w_k^2 \cdot c_k$$

Figure 6B:
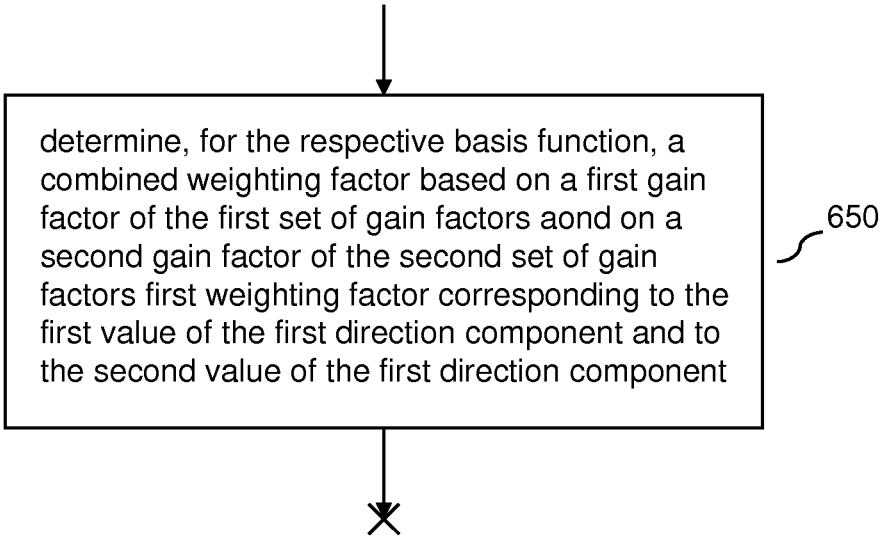
FIG. 6*b* is a flow chart illustrating a fourth exemplary method.

FIG. 6*b* depicts a fourth exemplary method of determining weighting factors for a basis function, which can be used for the first or second exemplary method depicted in FIGS. 3*a* and 3*b*, respectively, in order to determine the at least one weighting factor associated with each basis function.

This fourth exemplary method comprises, for the respective basis function, determining a combined weighting factor based on a first gain factor, selected from the first set of gain factors and on a second gain factor, selected from the second set of gain factors, the first gain factor being associated with the value of the first direction component and the second gain factor being associated with the value of the second direction component of the direction.

For example, a transfer function representative can be written as $$h(v1, v2) = \sum_{k=1}^{N} w_k(v1, v2) \cdot c_k$$

wherein $w_k$ (v1, v2) denotes the combined weighting factor associated with the k-th basis function. For instance, this combined weighting factor $w_k$ (v1, v2) may be determined by multiplying the first and the second weighting factors $w_k^1$ and $w_k^2$, wherein these first and second weighting factors may be determined as described with respect to the third exemplary method.

Figure 8:
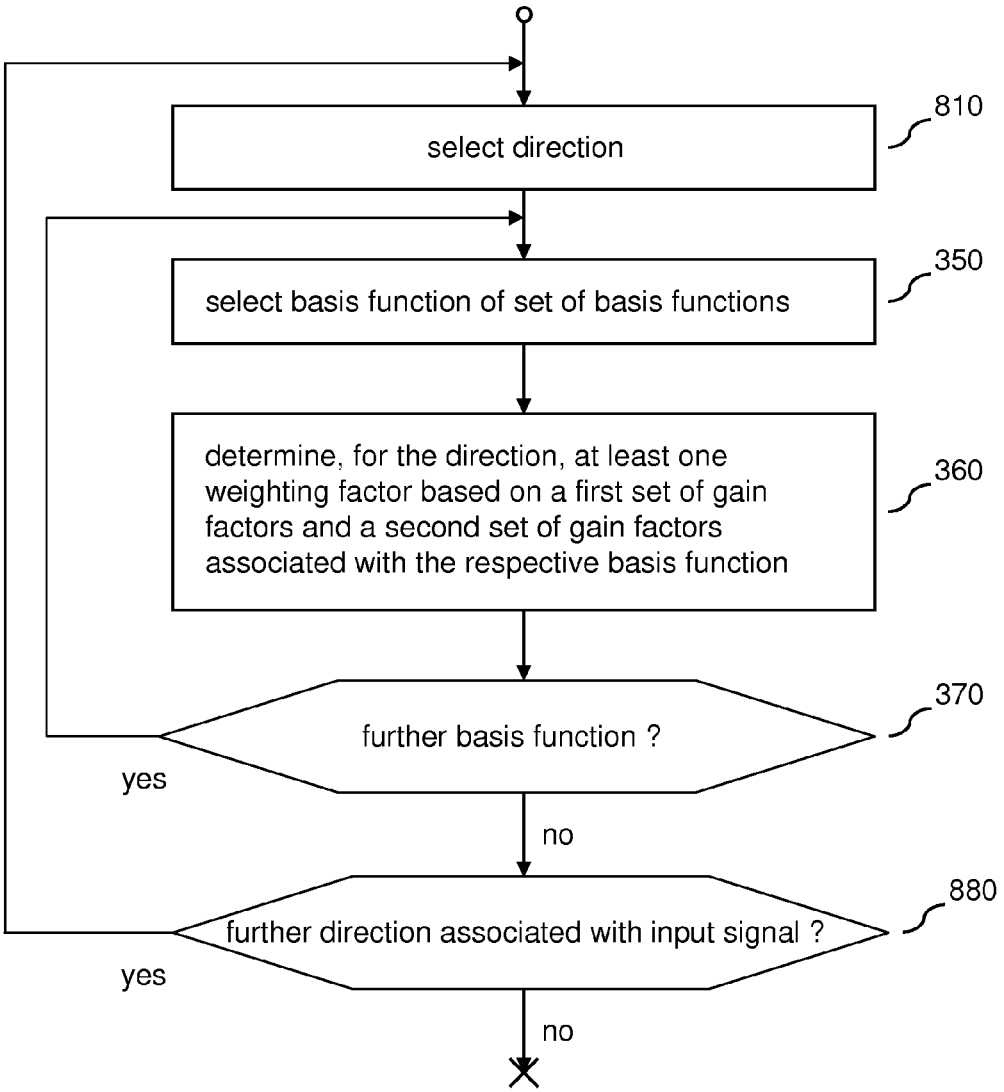
FIG. 8 is a flow chart illustrating a fifth exemplary method.

FIG. 8 depicts a fifth exemplary method of determining weighting factors for each basis function, wherein this fifth exemplary method is based on the second exemplary method depicted in FIG. 3*a*. Thus, the same reference signs are in the flowchart associated with the fifth exemplary method.

This fifth exemplary method comprises determining the weighting factors for each basis function for at least one direction. For example, this at least one direction may comprise a plurality of directions, wherein each of the plurality of directions is associated with a value of the first direction component and with a value of the second direction component.

One of the at least one direction is selected by the fifth exemplary method, as indicated by reference sign 810.

Then, for this selected direction, for each basis function of the set of basis functions at least one weighting factor is determined, as explained with respect to the preceding exemplary methods.

Afterwards, it is checked whether there exists a further direction, as indicated by reference sign 880, and if there is a further direction, the method selects this direction and repeats, for this selected direction, determining for each basis function of the set of basis functions at least one weighting factor.

Of course, as an exemplary alternative optional embodiment, determining for each basis function at least one weighting factor may be performed in parallel.

For example, the at least one weighting factor associated with a k-th basis function and a l-th direction may be represented by means of a combined weighting factor as described with respect to fourth exemplary method, wherein this weighting factor may be denoted as $w_{k,l}=w_k$ (v1, v2), wherein v1 represents the value of the first direction component of the l-th direction and v2 represents the value of the second direction component of the l-th direction.

Assuming that L represents the number of directions, L transfer function representatives can be determined.

Figure 9A:
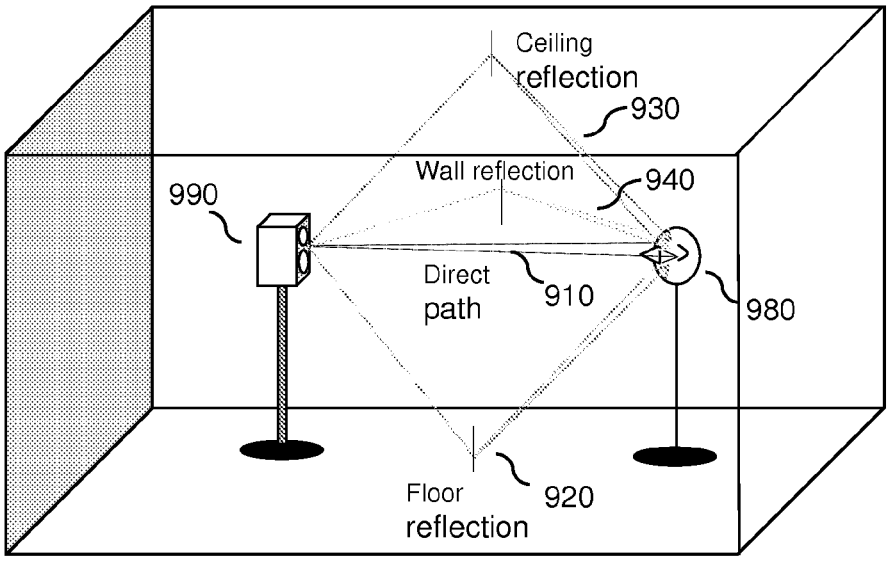
FIG. 9*a* depicts exemplary reflections in a listening environment.

FIG. 9*a* depicts reflections in a typical listening environment, wherein a real loudspeaker 990 emits a sound signal and a listener 980 receives different reflections of this sound signal in addition to the direct sound signal. For instance, the listener 990 receives the direct path sound 910, a floor reflection 920, a ceiling reflection 930 and a wall reflection 940. Each of the direct path 920 and the reflections 920, 930 and 940 can be associated with a separate direction with respect to the listener's 980 position. For instance, the first direction component may represent the azimuth dimension and the second direction component may represent the elevation dimension.

Then, for each of these directions the at least one weighting factor for each of the basis functions can be determined, and based on these determined weighting factors, a transfer function representative can be determined for each of these directions. For instance, these transfer function representatives may be used to filter the input signal of speaker 990 in order to model each reflection as a virtual speaker at the reflection point, as exemplarily depicted in FIG. 9*b*, wherein the signal of the direct path 910 is modelled as direct path virtual speaker (VS) and path 910', the reflection signal of the floor reflection path 920 is modelled as a floor VS and path 920', the reflection signal of the signal of the ceiling reflection path 930 is modelled as ceiling VS and path 930' and the reflection signal of the signal of the wall reflection path 940 is modelled as wall VS and path 940'. Each of the reflection paths 920, 930 and 940 can be associated with a separate time delay, wherein this time delay may represent the delay compared to the arrival of the direct path signal 910.

Thus, each reflection path may be modelled by means of the determined at least one weighting factor of each basis function, depending on the direction of the respective reflection path, and by means of a time delay.

Furthermore, the signal received via a reflection path may be considered as a modified version of the input signal, i.e. the respective direct signal, due to characteristics of the reflecting surface. The characteristics of reflecting surface may have an effect that modifies e.g. the frequency characteristics and/or amplitude of the signal, since soft surfaces, such a carpet on a floor, may have reflection characteristics quite different from hard surfaces, such as hardwood or concrete. Such a modification may be modelled for example by suitable filtering of the respective direct signal. Thus, as an example, in embodiment applying a filter to modify a signal in order to model characteristics of a reflecting surface, a reflection path may be modelled by means of a filter modelling the respective reflecting surface, by means of the determined at least one weighting factor of each of basis function, and by means of a time delay. In addition or as an alternative, modeling of factors like distance attenuation, source directivity, obstruction and/or occlusion may be included in a filter modeling a reflected signal path.

Figure 10A:
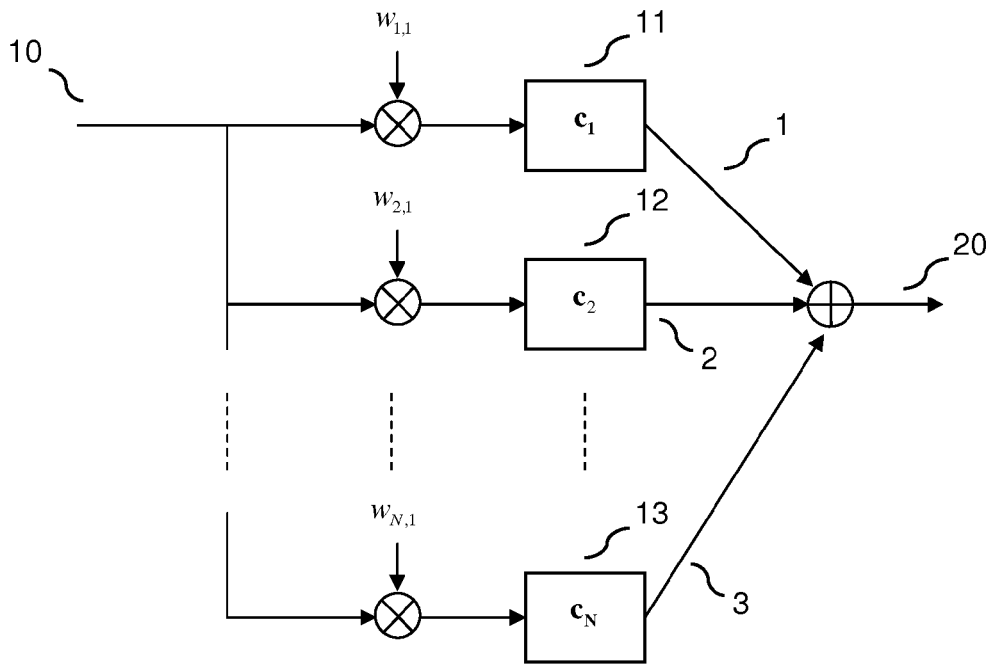
FIG. 10*a* is a first exemplary filtering.

FIG. 10*a* depicts a first exemplary filtering of an input signal 10.

This signal 10 is filtered by means of a filter function based on the set of basis functions $c_1 \ldots c_N$ and on the determined at least one weighting factor associated with each of the basis functions for a given direction. The set of basis functions and the determined weighting factors may be determined according to one of the exemplary methods explained above.

The at least one weighting factor for the k-th basis function are depicted as combined weighting factor $w_{k,l}=w_k$ (v1, v2) with l=1, because there is only one direction with respect to the first exemplary filtering.

The filter function applied in FIG. 10*a* corresponds to a weighted linear combination of the basis functions $c_1 \ldots c_N$, wherein each basis function of the set of basis functions is weighted by the combined weighting factor $w_{k,l}=w_k$ (v1, v2) associated with the k-th basis function $c_k$.

For each of the basis functions a scaled signal is determined based on multiplying the input signal 10 with the respective combined weighting factor $w_{k,l}$. Then, for each basis function, a filtered signal 1, 2, 3 is determined based on a convolution of the respective basis function $c_k$ and the respective scaled signal. For instance, the convolution associated with the first basis function is carried out by block 11, the convolution associated with the second basis function is carried out by block 12 and the convolution associated with the N-th basis function is carried out by block 13.

Afterwards, an output signal 20 is determined based on combining the filtered signals 1, 2, 3. Accordingly, the output signal 20 represents a filtered signal filtered with a transfer function representative according to the given direction. For instance, this transfer function representative may represent a HRTF for a given azimuth angle and a given elevation angle.

For instance, the input signal 10 can be filtered according to a virtual source direction in a three-dimensional (3D) auditory space. Accordingly, a virtual sound source in a 3D auditory space can be provided based on the set of basis functions and the determined at least one weighting factor for each basis function.

Figure 10B:
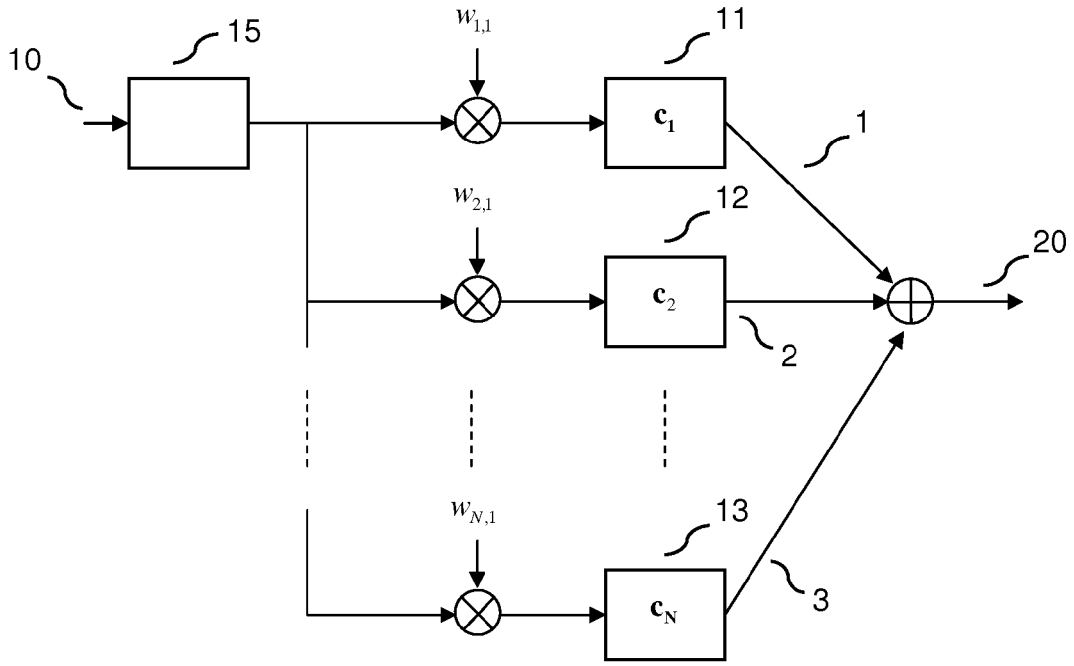
FIG. 10*b* is a second exemplary filtering.

FIG. 10*b* depicts a second exemplary filtering of an input signal 10, wherein this second exemplary filtering is based on the first exemplary filtering.

Compared to the first exemplary filtering, the second exemplary filtering comprises an element 15, which is configured to carry out a further signal processing with respect to the input signal. For instance, this element 15 may be configured to introduce a delay and/or a further filtering.

For instance, this second exemplary filtering may be applied for modelling further characteristics, e.g. modelling a reflecting surface.

Thus, a reflection path may be modelled by means of a filter modelling the respective reflecting surface, by means of the determined at least one weighting factor of each of basis function, and by means of a time delay. For instance, the element 15 comprises the filter modelling the respective reflecting surface and is configured to introduce the time delay, but any other well-suited arrangement of the filtering and/or time delay may also be used. For instance, if element 15 only introduces the time delay, the filtering modelling the respective reflective surface could be applied to input signal 10 prior to introducing the time delay by means of element 15, or after the time delay has been introduced and before the filtering of the first exemplary method is performed, or this filtering modelling the respective reflective surface may be applied to signal 20, i.e. after the filtering of the first second exemplary method is performed.

Furthermore, as an alternative exemplary approach, the type of reflecting surface may be modelled as an additional dimension to the database: The characteristics of a reflecting surface may be modelled by combining a HRTF filter associated with a given direction and a filter used for modelling characteristics of a given reflecting surface to create a filter modelling a reflection arriving from the respective direction, reflected by the respective type of surface. Combining may be accomplished for example by convolving a HRIR associated with a given direction and the impulse response of the filter modelling the characteristics of respective reflecting surface. A combined filter of similar kind may be created for each considered direction of arrival for each considered type of reflecting surface. In the decomposition side, this may be represented as an additional dimension to the original HRTF database, whereas in the composition side this may contribute as an additional gain value contributing to the weighting factors of each basis function.

Thus, with respect to this alternative exemplary approach, the element 15 may introduce a time delay being associated with a special reflection path, and the combined weighting factor $w_{k,1}$ of a k-th basic function and a l-th direction further depends on a value v3 ($w_{k,1}=w_k$ (v1, v2, v3)), wherein this value v3 represents a weighting factor which is determined based on a further set of gain factors associated with the characteristics of a reflecting surface.

The explanations presented with respect to this second exemplary filtering in FIG. 10*b* may also hold for the succeeding exemplary filterings.

Figure 10C:
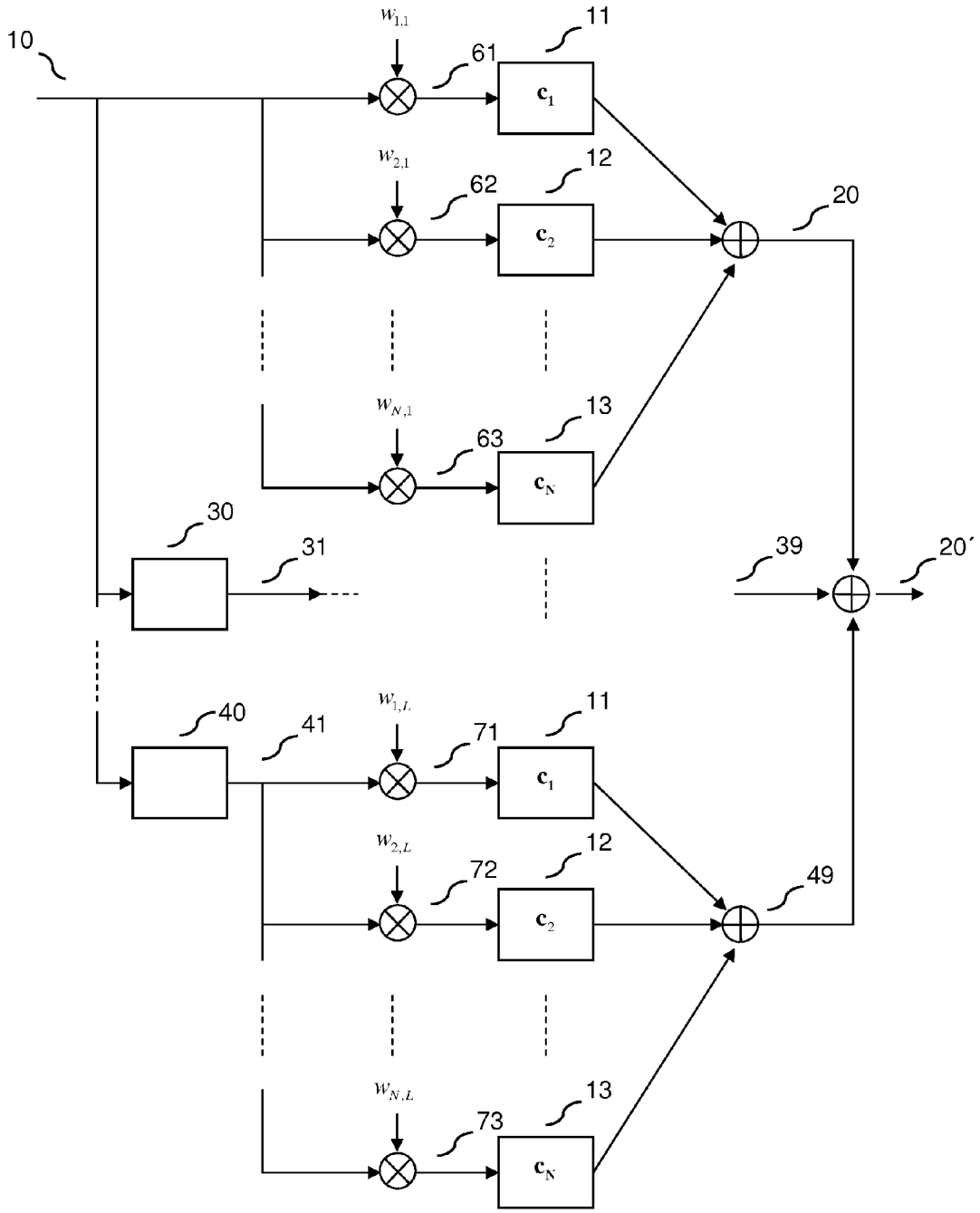
FIG. 10*c* is a third exemplary filtering.

FIG. 10*c* depicts a third exemplary filtering of an input signal 10, wherein this third exemplary filtering is based on the first exemplary filtering and on the second exemplary filtering.

This third exemplary filtering is directed to a method for filtering the input signal 10 with transfer functions associated with different directions. In this third exemplary filtering, the input signal 10 is associated with L different directions.

For each direction of these L directions, and for each basis function at least one weighting factor is determined. As an example and without any limitations, the combined weighting factor $w_{k,1}$ may used for representing the determined at least one weighting factor being associated with the k-th basis function and the l-th direction.

Thus, for each direction and for each basis function a scaled signal 61, 62, 63, 71, 72, 73 is determined on the basis of the input signal 10 and the at least one weighting factor associated with the respective k-th basis function and the respective l-th direction.

Furthermore, a time delay may be introduced to at least one of the scaled signals. For instance, this time delay may be introduced to all scaled signals associated with one common direction. As depicted in FIG. 10*c*, a time delay 30 is introduced to the scaled signal associated with the 2nd direction by delaying the input signal 10. The delayed signal 31 can then be fed to the multipliers of the respective combined weighting factors $w_{k,2}$ associated with the respective (i.e. 2nd) direction (not depicted in FIG. 10*b*). This time delay can be used to model a time delay of a signal associated with a reflection path.

Accordingly, a time delay can be introduced to any of the 1 directions, e.g. block 40 can be used to delay the input signal associated with the L-th direction, thereby outputting a delayed signal 41, such that each scaled signal 71, 72, 73 associated with the L-th direction is delayed.

Furthermore, as an example and as explained with respect to the second exemplary filtering, any of blocks 30 and 40 may further comprise a filter modelling the respective reflecting surface associated with the respective direction, but this filtering may also be applied prior to introducing the delay by means of blocks 30 and 40, or after this delay has been introduced, i.e. to signals 31 and 41), or after the HRTF modelling has been applied, i.e. to signals 39, 49.

Furthermore, as another exemplary alternative, the determining of the combined weighting factor for the respective basis function may be based on a further set of gain factors associated with the characteristics of a reflecting surface. This may be used for modelling the respective reflecting surface, wherein the combined weighting factor $w_{k,1}$ of a k-th basic function and a 1-th direction further depends on a value v3 representing a weighting factor which is determined based on the further set of gain factors associated with the characteristics of a reflecting surface, i.e. the combined weighting factor $w_{k,1}$ depends on three weighting factors v1, v2 and v3: $w_{k,1}=w_k$ (v1, v2, v3).

As an example, any of blocks 30 and 40 may correspond to element 15 depicted in FIG. 10*b*.

Thus, the third exemplary filtering allows filtering an input signal 10 with transfer functions associated with different directions, thereby outputting a respective filtered signal 20, 39, 49 for each of the directions. These outputted filtered signals 20, 39, 49 can be combined in order to determine an output signal 20'.

Figure 9B:
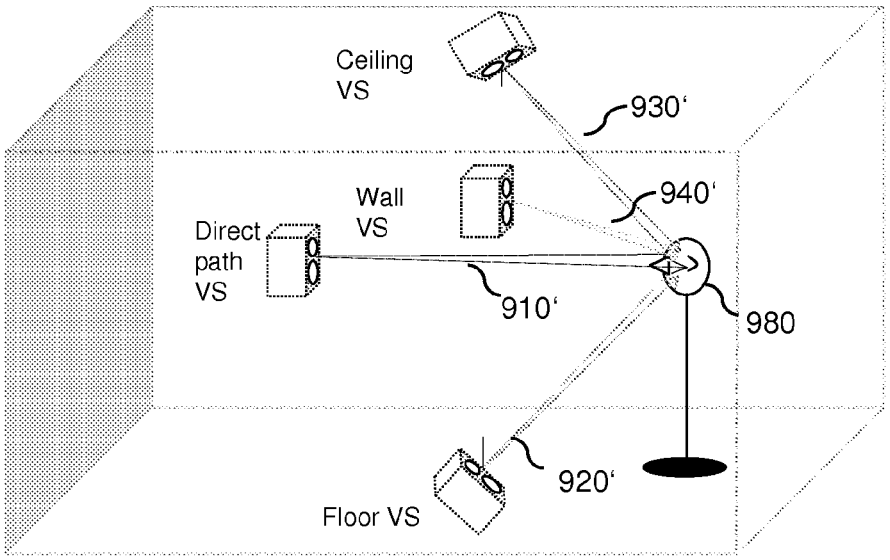
FIG. 9*b* depicts an exemplary reflection modeled as virtual speaker for the environment of FIG. 9*a;*

For instance, with respect to the scenario depicted in FIGS. 9*a* and 9*b*, the combined weighting factors $w_{k,1}$ of the first direction can be associated with the direct path 910 and the direction of this path 910, the combined weighting factors $w_{k,2}$ of the second direction can be associated with the floor reflection 920 and the direction of this path 920, the combined weighting factors $w_{k,3}$ of the third direction can be associated with the ceiling reflection 930 and the direction of this path 930, and the combined weighting factors $w_{k,L}=4$ of the fourth direction can be associated with the wall reflection 940 and the direction of this path 940.

The delay 30 associated with the second direction may represent the time delay associated with the floor reflection path 920 and the delay 40 associated with the fourth direction may represent the time delay associated with the wall reflection path 940. Furthermore, a time delay may be introduced to the third direction associate may be introduced (not depicted in FIG. 10*b*) representing the time delay associated with the ceiling path 930. Accordingly, a listener 980 listening to the output signal 20' would have the impression of listening to different virtual sound reflections according to different positions in the 3D auditory space.

Thus, the determined at least one weighting factors for the respective basis functions and the respective directions can be used for filtering an input signal 10 in accordance with different virtual source directions in a three-dimensional (3D) auditory space.

Figure 10D:
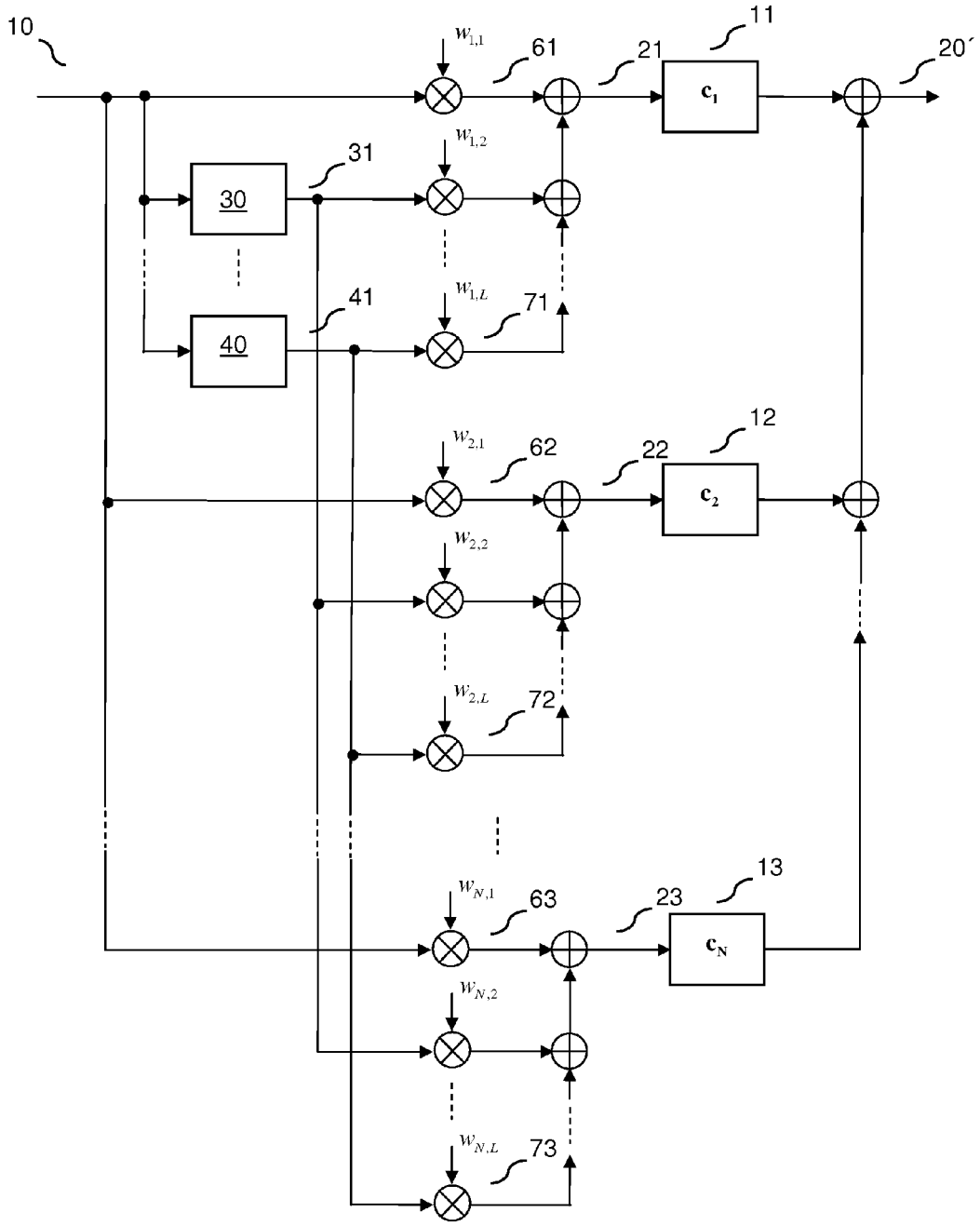
FIG. 10*d* is a fourth exemplary filtering.

FIG. 10*d* depicts a fourth exemplary filtering of an input signal 10, wherein this fourth exemplary filtering is based on the first, second and third exemplary filtering.

This fourth exemplary filtering differs from the third exemplary filtering in the feature that for each of the basis functions $c_1 \ldots c_N$ a combined scaled signal 21, 22, 23 is determined on the basis of the scaled signals being associated with the respective basis function.

For instance, with respect to the first basis function $c_1$, the combined scaled signal 21 is determined on the scaled signals 61, 71 associated with the combined weighting factors $w_{1,1} \ldots w_{1,L}$. Of course, a delay may be introduced to at least one of the scaled signals, as indicated by blocks 30 and 40 in FIG. 10*c*. Accordingly, only one convolution is necessary with respect to the first basis function $c_1$. The same holds for the remaining basis functions.

Consequently, only N convolutions are necessary regardless of the numbers of directions associated with the input signal 10. Every time a new virtual source with a new direction is added, N additional multiplications are needed, but the number of convolutions remains constant.

The output signal 20' depicted in FIG. 10*d* corresponds to the output signal 20' depicted in FIG. 10*c*.

Figure 10E:
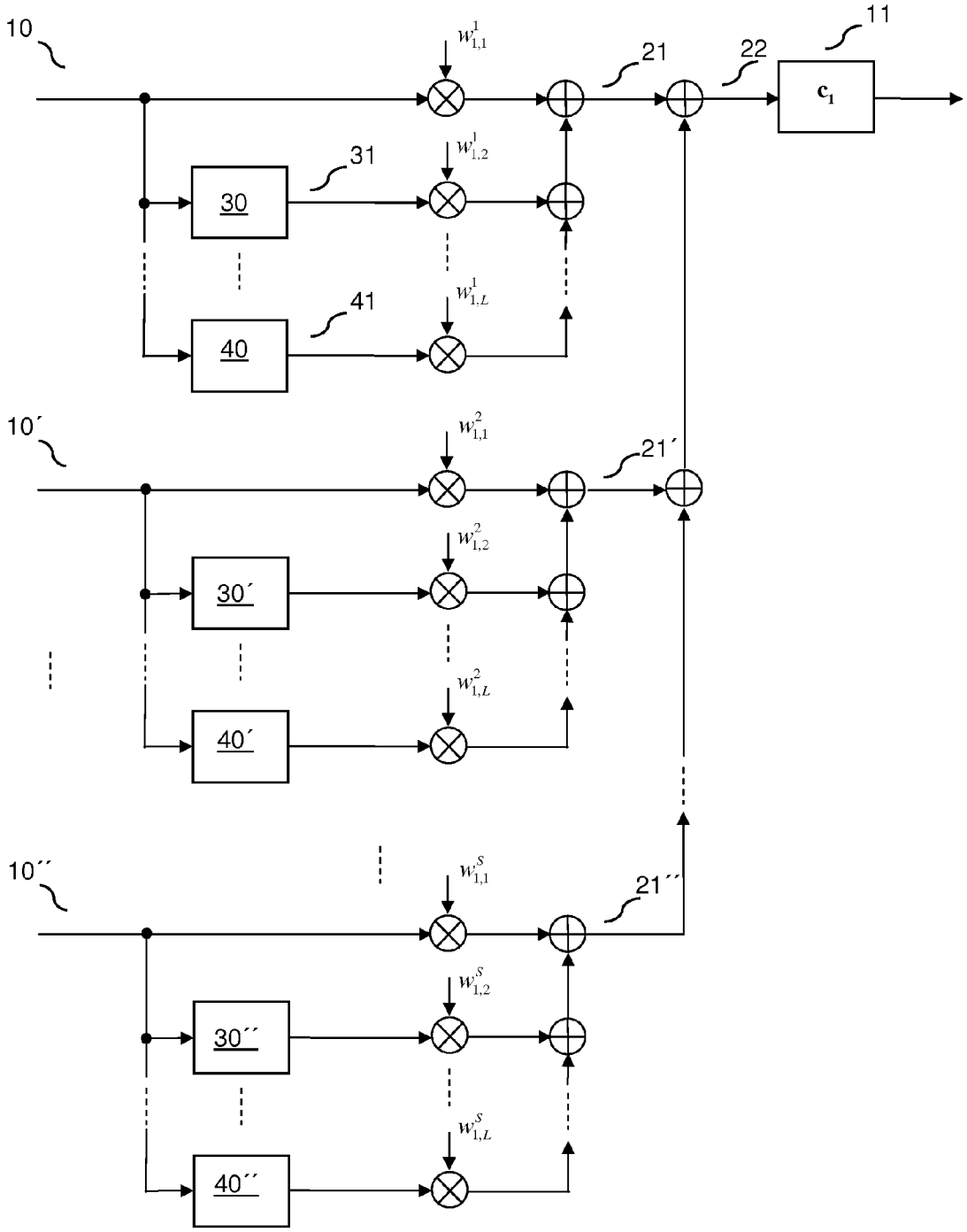
FIG. 10*e* is a fifth exemplary filtering.

FIG. 10*e* depicts a fifth exemplary filtering of several input signals 10, 10', 10", wherein this fifth exemplary filtering is based on the fourth exemplary filtering.

The fifth exemplary filtering is directed to a plurality of input signals 10, 10', 10", wherein each of the input signals can be associated with a separate direction and with a separate time delay.

In the fifth exemplary filtering depicted in FIG. 10*e* it is assumed that each input signal is associated with L directions, wherein these directions may be associated with different reflections in the 3D auditory space, but each input signal can also be associated with a different number of directions.

For instance, each of the plurality of input signals 10, 10', 10" may be associated with a separate surround source. As an example, the input signals may represent a center source, a front left source, a front right source, a rear left source and a rear right source of a 5-channel surround system.

For each of the input signals 10, 10' . . . 10", the method comprises for each basis function (FIG. 10*e* only depicts the first basis function) determining a combined scaled signal 21, 21' . . . 21", wherein each of these combined scaled signals 21, 21' . . . 21" is determined for the respective input signal as described with respect to the combined scaled 21 of the fourth exemplary filtering. Then, these combined scaled signals 21, 21' . . . 21" being associated with the first basis function are combined to multi-combined signal 22. Thus, these combined scaled signals, wherein each of these plurality of scaled signal is determined on the basis of the respective input signal of the plurality of input signals multiplied by the at least one weighting factor associated with the respective k-th basis function and the l-th respective direction, are combined to multi-combined signal 22 before the convolution with the respective basis function is performed. This at least one weighting factor can be represented by the combined weighting factor $w_{k,l}^{s}$, k denoting the k-th basis function, s denoting the s-th input signal and l denoting the l-th direction of the s-th input signal.

FIG. 10*e* only depicts the convolution with respect to the first basis function, but the scheme depicted in FIG. 10*e* can be applied to any of the basis functions. Afterwards the outputs of the convolutions of the different basis functions can be combined to one output signal.

Figure 11A:
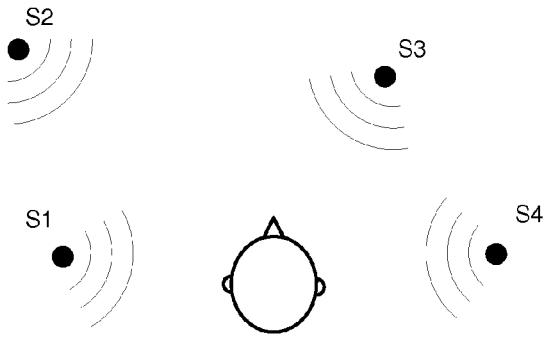
FIG. 11*a* is an exemplary arrangement of a four virtual surround sources.

FIG. 11*a* depicts an exemplary arrangement of a four virtual surround sources S1, S2, S3, S4. S1 and S2 are arranged on the left side of the listener, and S3 and S4 on the right.

Figure 11B:
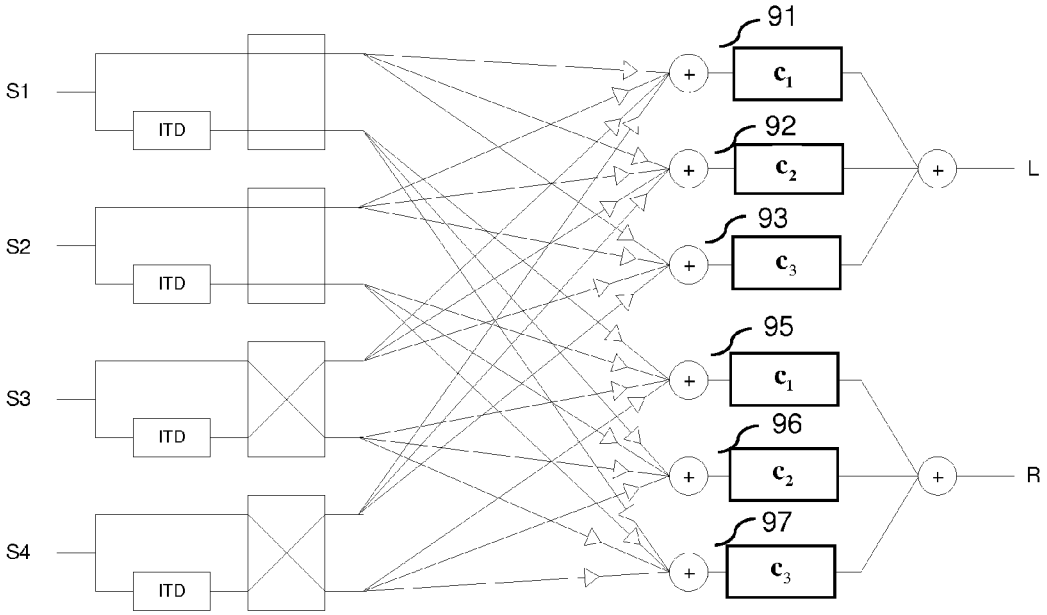
FIG. 11*b* is a sixth exemplary filtering.

FIG. 11*b* depicts a sixth exemplary filtering on how to run the four virtual sources S1, S2, S3 and S4 by using three basis functions $c_1 \ldots c_3$ in accordance with the fifth exemplary filtering depicted in FIG. 10*e*. The scaling with the determined at least one weighting factor, in FIG. 10*e* depicted by scaling with combined weighting factors $w_{k,l}^{s}$, is not shown in FIG. 11*b* but performed by the sixth exemplary filtering. Any other number of basis functions may be applied instead of three.

Two copies of the basis functions $c_1 \ldots c_3$ must be run, one designated to generate the output for the left ear and one for the right ear. An Interaural Time Difference (ITD) is introduced as a respective time delay to the right output (R) for S1 and S2 and to the left output (L) for S3 and S4.

Each of the multi combined signals 91, 92, 93, 94, 95, 96 and 97 may be determined based on the explanations presented with respect to the fifth exemplary filtering. For instance, with respect to the multi combined signal 91 associated with the first basis function and with the left channel, this multi combined signal 91 may represent the sum of a plurality of scaled signals, wherein each of these plurality of scaled signal is determined on the basis of the respective input signal of the plurality of input signals S1, S2, S3, S4 multiplied by the at least one weighting factor associated with the respective basis function (i.e. 1st basis function) and the respective direction associated with the respective input signal. Furthermore, time delays ITD can be introduced corresponding to the time delays 30, 30', 30", 40, 40', 40" explained with respect to the preceding exemplary filterings.

Thus, generating the left output signal L can be performed based on the fifth exemplary filtering and generating the right output signal R can be performed based on the fifth exemplary filtering. It has to be understood that each of the presented exemplary filterings can be applied for a left channel associated with the left ear of a listener and for a right channel associated with the right ear of a listener, respectively, thereby using the same set of basis functions.

Furthermore, it is readily clear for a person skilled in the art that the logical blocks in the schematic block diagrams as well as the flowchart and algorithm steps presented in the above description may at least partially be implemented in electronic hardware and/or computer software, wherein it may depend on the functionality of the logical block, flowchart step and algorithm step and on design constraints imposed on the respective devices to which degree a logical block, a flowchart step or algorithm step is implemented in hardware or software. The presented logical blocks, flowchart steps and algorithm steps may for instance be implemented in one or more digital signal processors (DSPs), application specific integrated circuits (ASICs), field programmable gate arrays (FPGAs) or other programmable devices. The computer software may be stored in a variety of computer-readable storage media of electric, magnetic, electro-magnetic or optic type and may be read and executed by a processor, such as for instance a microprocessor. To this end, the processor and the storage medium may be coupled to interchange information, or the storage medium may be included in the processor.

Any presented connection in the described embodiments is to be understood in a way that the involved components are operationally coupled. Thus, the connections can be direct or indirect with any number or combination of intervening elements, and there may be merely a functional relationship between the components.

Any of the processors mentioned in this text could be a processor of any suitable type. Any processor may comprise but is not limited to one or more microprocessors, one or more processor (s) with accompanying digital signal processor (s), one or more processor (s) without accompanying digital signal processor (s), one or more special-purpose computer chips, one or more field-programmable gate arrays (FPGAS), one or more controllers, one or more application-specific integrated circuits (ASICS), or one or more computer(s). The relevant structure/hardware has been programmed in such a way to carry out the described function.

Any of the memories mentioned in this text could be implemented as a single memory or as a combination of a plurality of distinct memories, and may comprise for example a read-only memory, a random access memory, a flash memory or a hard disc drive memory etc.

Moreover, any of the actions described or illustrated herein may be implemented using executable instructions in a general-purpose or special-purpose processor and stored on a computer-readable storage medium (e.g., disk, memory, or the like) to be executed by such a processor. References to 'computer-readable storage medium' should be understood to encompass specialized circuits such as FPGAs, ASICs, signal processing devices, and other devices.

It will be understood that all presented embodiments are only exemplary, that features of these embodiments may be omitted or replaced and that other features may be added. Any mentioned element and any mentioned method step can be used in any combination with all other mentioned elements and all other mentioned method step, respectively. It is the intention, therefore, to be limited only as indicated by the scope of the claims appended hereto.

The invention claimed is:

1. A method comprising:

determining, for a direction being at least associated with a value of a first direction component and with a value of a second direction component, at least one weighting factor for each basis function of a set of basis functions, each of the basis functions being associated with an audio transfer characteristic, wherein said determining comprises multiplying one of a first set of gain factors, associated with the first direction component, with one of a second set of gain factors, associated with the second direction component; and using the determined at least one weighting factor for each basis function to construct a filter at least based on decomposing a given multi-dimensional transfer function database, arranged in a multi-way array having at least three dimensions, into the set of first gain factors being associated with the first direction component, the set of second gain factors being associated with the second direction component and a set of basis functions.

2. The method according to claim 1, wherein the first direction component represents an azimuth dimension and the second direction component represents an elevation dimension.

3. The method according to claim 1, wherein the first set of gain factors comprises a plurality of first subsets of gain factors, each subset of the plurality of first subsets of gain factors being associated with one basis function of the set of basis functions, and wherein the second set of gain factors comprises a plurality of second subsets of gain factors, each subset of the plurality of second subsets of gain factors being associated with one basis function of the set of basis functions.

4. The method according to claim 1, wherein the set of basis functions, the first set of gain factors and the second set of gain factors are associated with head related transfer functions.

5. The method according to claim 1, wherein determining the at least one weighting factor for each basis function comprises for a respective basis function:

determining a first weighting factor being associated with the value of the first direction component of the direction based on the set of first gain values for the respective basis function, and determining a second weighting factor being associated with the value of the second direction component of the direction based on the set of second gain values for the respective basis function.

6. The method according to claim 5, wherein determining the first weighting factor is based on one out of:

selecting a gain value of the first set of gain values being associated with the value of the first direction component for the respective basis function;

determining an interpolated gain value based on the first set of gain values being associated with the value of the first direction component for the respective basis function;

determining an extrapolated gain value based on the first set of gain values being associated with the value of the first direction component for the respective basis function;

and wherein determining the second weighting factor is based on one out of:

selecting a gain value of the second set of gain values being associated with the value of the second direction component for the respective basis function;

determining an interpolated gain value based on the second set of gain values being associated with the value of the second direction component for the respective basis function; and determining an extrapolated gain value based on the second set of gain values being associated with the value of the second direction component for the respective basis function.

7. The method according to claim 1, wherein said determining at least one weighting factor for the respective basis function is further based on at least one further set of gain factors.

8. The method according to claim 1, wherein the set of basis functions is associated with audio transfer characteristics.

9. The method according to claim 8, wherein the first set of gain factors comprises a plurality of first subsets of gain factors, each subset of the plurality of first subsets of gain factors being associated with one basis function of the set of basis functions, and wherein the second set of gain factors comprises a plurality of second subsets of gain factors, each subset of the plurality of second subsets of gain factors being associated with one basis function of the set of basis functions.

10. The method according to claims 8, wherein a first dimension of the array is associated with the first direction component, a second dimension of the array is associated with the second direction component, and the third dimension is associated with a transfer function representative.

11. The method according to claim 8, wherein the decomposing is one out of:

a Parallel Factor (PARAFAC) decomposition; and a Tucker decomposition.

12. An apparatus comprising at least one processor and at least one memory storing computer program code, wherein the at least one memory and stored computer program code are configured, with the at least one processor, to cause the apparatus to at least:

determine, for a direction being at least associated with a value of a first direction component and with a value of a second direction component, at least one weighting factor for each basis function of a set of basis functions, each of the basis functions being associated with an audio transfer characteristic, wherein said determining comprises multiplying one of a first set of gain factors, associated with the first direction component, with one of a second set of gain factors, associated with the second direction component: and use the determined at least one weighting factor for each basis function to construct a filter at least based on decomposing a given multi-dimensional transfer function database, arranged in a multi-way array having at least three dimensions, into the set of first gain factors being associated with the first direction component, the set of second gain factors being associated with the second direction component and a set of basis functions.

13. The apparatus according to claim 12, wherein the at least one memory and the computer program code, with the at least one processor, are configured to cause the apparatus to perform, for each input signal of at least one input signal, said determination the at least one weighting factor for each basis function of a set of basis functions for each direction of at least one direction associated with the respective input signal.

14. The apparatus according to claim 13, wherein the at least one memory and stored computer program code are configured, with the at least one processor, to cause the apparatus to perform, for each input signal of the at least one input signal:

filter the respective input signal, for each direction associated with the respective input signal, with a filter function based on the set of basis functions and on the determined at least one weighting factors associated with each of the basis functions for the respective direction of the respective input signal.

15. The apparatus according to claim 13, wherein the apparatus is one of:

a chip;

an integrated circuit; and an audio device.

16. The apparatus of claim 13, wherein the set of basis functions is associated with audio transfer characteristics.

17. The apparatus according to claim 16, wherein a first dimension of the array is associated with the first direction component, a second dimension of the array is associated with the second direction component, and the third dimension is associated with a transfer function representative.

18. The apparatus according to claim 16, wherein the apparatus is one of:

a chip;

an integrated circuit; and an audio device.

19. A computer program code stored in a non-transitory computer readable storage medium, causing an apparatus to perform the following when executed on a processor:

determine, for a direction being at least associated with a value of a first direction component and with a value of a second direction component, at least one weighting factor for each basis function of a set of basis functions, each of the basis functions being associated with an audio transfer characteristic, wherein said determination comprises multiplying one of a first set of gain factors, associated with the first direction component, and one of a second set of gain factors, associated with the second direction component; and use the determined at least one weighting factor for each basis function to construct a filter at least based on decomposing a given multi-dimensional transfer function database, arranged in a multi-way array having at least three dimensions, into the set of first gain factors being associated with the first direction component, the set of second gain factors being associated with the second direction component and a set of basis functions.

20. The computer program code of claim 19, wherein the set of basis functions is associated with audio transfer characteristics.

* * * * *